US007641565B2

(12) United States Patent
Kiraly

(10) Patent No.: US 7,641,565 B2
(45) Date of Patent: Jan. 5, 2010

(54) METHOD AND APPARATUS FOR DETECTING THE PLACEMENT OF A GOLF BALL FOR A LAUNCH MONITOR

(75) Inventor: Christopher M. Kiraly, San Diego, CA (US)

(73) Assignee: Wintriss Engineering Corporation, San Diego, CA (US)

( * ) Notice: Subject to any disclaimer, the term of this patent is extended or adjusted under 35 U.S.C. 154(b) by 321 days.

(21) Appl. No.: 11/610,906

(22) Filed: Dec. 14, 2006

(65) Prior Publication Data

US 2007/0298898 A1 Dec. 27, 2007

Related U.S. Application Data

(60) Provisional application No. 60/804,540, filed on Jun. 12, 2006.

(51) Int. Cl.
*A63B 67/02* (2006.01)

(52) U.S. Cl. ..... 473/151

(58) Field of Classification Search ..... 463/42; 473/131, 140, 141, 198–200, 219–226, 409, 473/42, 151; 700/91, 92; 348/155–157; 382/103; 273/317.2
See application file for complete search history.

(56) References Cited

U.S. PATENT DOCUMENTS

| | | | | |
|---|---|---|---|---|
| 6,431,990 | B1 * | 8/2002 | Manwaring | 473/199 |
| 6,565,448 | B2 * | 5/2003 | Cameron et al. | 473/131 |
| 6,616,543 | B1 * | 9/2003 | Gobush et al. | 473/199 |
| 6,764,412 | B2 * | 7/2004 | Gobush et al. | 473/199 |
| 6,781,621 | B1 * | 8/2004 | Gobush et al. | 348/157 |
| 7,369,158 | B2 * | 5/2008 | Gobush et al. | 348/169 |
| 2008/0287207 | A1 * | 11/2008 | Manwaring | 473/199 |

OTHER PUBLICATIONS

International Search Report Dated Aug. 1, 2008.

* cited by examiner

*Primary Examiner*—Ronald Laneau
(74) *Attorney, Agent, or Firm*—Manuel F. de la Cerra

(57) ABSTRACT

A novel method and apparatus for detecting the placement of a golf ball for a launch monitor is disclosed. The method comprises capturing an image of a scan zone that is adjacent to the launch monitor and in the field of view of the launch monitor's image sensor, analyzing the scan zone image for the placement of an object, and determining if the object is likely the golf ball. An apparatus is also disclosed that implements the golf ball detection method.

41 Claims, 18 Drawing Sheets

METHOD AND APPARATUS FOR DETECTING THE PLACEMENT OF A GOLF BALL FOR A LAUNCH MONITOR

CLAIM OF PRIORITY

This application claims priority to U.S. provisional application No. 60/804,540, entitled "Golf Ball Launch Monitor", which was filed on Jun. 12, 2006. This application is related to U.S. patent application Ser. No. 10/456,054, entitled "Flight Parameter Measurement System", which was filed on Jun. 6, 2003; to U.S. patent application Ser. No. 10/911,009, entitled "Flight Parameter Measurement System", which was filed on Aug. 3, 2004; to U.S. patent application Ser. No. 11/610,845, entitled "Foldable Launch Monitor for Golf" filed concurrently herewith on Dec. 14, 2006; and to U.S. patent application Ser. No. 11/610,889, entitled "An Integrated Golf Ball Launch Monitor" filed concurrently herewith on Dec. 14, 2006. All of these applications are incorporated herein by reference.

FIELD OF THE INVENTION

This invention relates to golf ball launch monitors. More particularly, the invention relates to devices and processes for efficiently measuring flight parameter information for a golf ball.

BACKGROUND

A golf ball launch monitor is an electronic device for assisting a golfer in improving his or her game. More particularly, the monitor is used to analyze the initial path of the golf ball after it is struck by a golf club, and to present to the golfer the likely flight path information for the ball. Typically, the flight path information will include ball speed, ball direction, spin, and a projected flight path or distance. The launch monitor typically has an imager piece which couples to a computer and display. The imager piece is placed close to where the golfer is expected to hit the ball, with the imager's sensor directed toward the ball or tee. Usually, the golfer manually levels the monitor before use, or an external calibration device is used to level the monitor. The computer and display, which are often mounted on a cart, are connected to the imager. The golfer places marks or other indicia on the golf ball, and places the golf ball in the predetermined hitting spot. The golfer configures the launch monitor according to the club to be used or makes adjustments based on the predicted ball speed, and sets the launch monitor to monitor for the golf ball launch. Often, the launch monitor has one or more microphones for detecting the distinctive sound of a golf ball strike, or uses a radar horn to detect that the ball or club head is moving. Once a launch is detected, the monitor acquires a set sequence of images, and analyzes those images to find the golf ball, locate the special marks, and determine spin, speed, and direction. If the monitor is aware of which club the golfer is using and approximate swing speed, the timing for the sequence of images may be adjusted to more reliably have the golf ball in the image frame. For example, a chipping club may require a slower frame rate, since a chip shot is typically relatively slow, while a drive may require a much faster frame rate. If the launch monitor is not aware of the club and swing speed or the estimated speed of the shot, or the ball is not placed in the correct position, then image capture can be unreliable and result in an erroneous measurement.

SUMMARY OF THE INVENTION

The present invention provides a novel method and apparatus for detecting the placement of a golf ball for a launch monitor. The method comprises capturing an image of a scan zone, the scan zone being an area adjacent the launch monitor and in the field of view of the launch monitor's image sensor, analyzing the scan zone image for the placement of an object, and determining if the object is likely the golf ball.

Several refinements may be added to this method. For example, the determining step may include comparing the object to a predefined physical attribute that may include size, dimple pattern, reflectivity, roundness, shading, gradient, and position. The method may also process the scan zone image to determine an exposure characteristic or location characteristic for the golf ball, to adjust exposure or window settings for a next image, or to illuminate a lamp. The method may also generate an alert that the golf ball has been determined to be in the scan zone, or an alert that the object has been determined not likely to be the golf ball. The method may also include generating a directional alert to indicate how the object should be moved to place the object in a strike zone. The method may capture a series of scan zone images. Also, the method may capture, responsive to the placement of the object, a second image and use the second image in determining if the object is likely the golf ball. The second image may be of a higher resolution than the image of the scan zone. The method may use a single sensor such that the image of the scan zone is captured with a window on the single sensor, and the second image is captured with a second window on the single sensor. The method may also use multiple sensors. For example, a first sensor may be used by the method to capture the image of the scan zone and a second sensor to capture the second image.

An apparatus is also provided that implements the golf ball detection method. The apparatus (and for that matter, the method) may further include using a CMOS or CCD sensor when capturing the image.

BRIEF DESCRIPTION OF THE DRAWINGS

The invention can be better understood with reference to the following figures. The components within the figures are not necessarily to scale, emphasis instead being placed upon clearly illustrating the principles of the invention. It will also be understood that certain components and details may not appear in the figures to assist in more clearly describing the invention.

DETAILED DESCRIPTION

Figure 1:
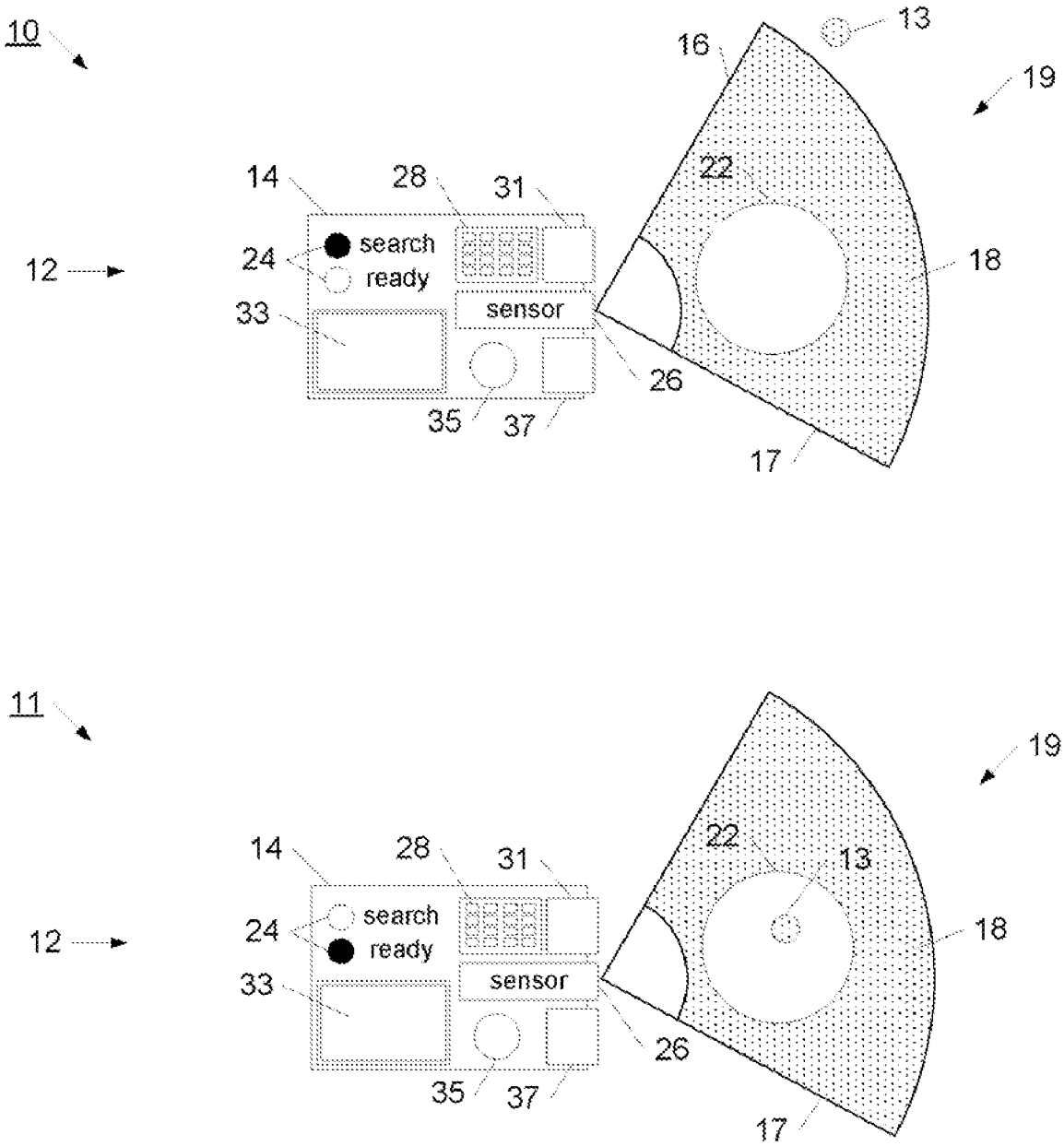
FIG. 1 is an illustration of a launch monitor system in accordance with the present invention.

Referring now to FIG. 1, a launch monitor system 12 is illustrated. Launch monitor 12 is constructed for use as a golf instructional aide, as part of a golf simulation game or as part of a club fitting system. Advantageously, launch monitor 12 enables an automated process for positioning a golf ball in a proper position, indicating to a golfer that the golf ball may be struck, and measuring and presenting flight path information regarding the launched golf ball. Current techniques require trial and error, physical measurements aids or hitting several test shots followed by position or parameter adjustments to establish proper hitting position. Additionally current techniques are prone to false or no trigger due to unwanted external stimulus or variations in ball-club contact. Launch monitor 12 is preferably constructed as a unitary portable device capable of being used in multiple locations. For example, launch monitor 12 may be used at a driving range, a chipping location, a putting green, an indoor practice facility, or a cruise ship. It would be apparent that the launch monitor 12 is certainly not limited to these venues. Typically, a golfer will use launch monitor 12 for providing immediate feedback as to the golfer's swing performance. Also, launch monitor 12 is constructed in a way that allows a golfer to use standard golf balls, practice golf balls, range balls, and their usual golf clubs. In this way, no special equipment or set up is required for the golfer to obtain the benefits of launch monitor 12.

Advantageously, the launch monitor may be quickly and easily setup and prepared for use, and requires minimal input from the golfer. In some cases, the launch monitor may be used with no golfer input at all. Further, the launch monitor works with nearly any golf ball, and with any club: putters, chippers, short irons, long irons, woods, and drivers. For example, a golfer can place the launch monitor next to a driving range tee, activate it, place a ball, and hit the ball with any club. The golfer need not tell the monitor what type of ball is being hit, or which club will be used. The golfer does not even need to tell the monitor if the type of hit will be a chip or drive. This ease of use allows a golfer to concentrate on their golf practice, without the burden of setting configurations.

Launch monitor 12 will be described in use as an instructional aide at a practice driving range. However, it will be understood that launch monitor 12 may be advantageously used for several purposes, such as, but not limited to, chipping instruction, putting instruction, club fitting and as an input device for a golf simulation game or computer. Launch monitor 12 may be constructed in a case for positioning on the ground near a hitting area 19 at a driving range. Often, the hitting areas at driving ranges are set apart separate spaces for each golfer, and may have mats of artificial grass or dividers between areas. In other arrangements, hitting area 19 may be more free-form, allowing golfers more flexibility in positioning themselves and the launch monitor 12. In most driving ranges, space is limited, so launch monitor 12 will be positioned within a foot or two of where the golfer would expect to drive the ball from.

When positioned adjacent hitting area 19, the launch monitor 12 has a sensor system 26 which has a field of view represented between lines 16 and 17. Typically, sensor or sensor system 26 has speed and resolution characteristics set for properly identifying and measuring golf ball characteristics. Accordingly, there is a scan area 18 where, depending upon illumination and environmental conditions, the launch monitor 12 can reliably and robustly detect a golf ball. For example, as shown in arrangement 10, golf ball 13 is outside the scan area 18. Launch monitor 12 would not be able to reliably detect the presence of golf ball 13. Launch monitor 12 also has indicator 24 for presenting status information to the golfer. As illustrated in arrangement 10, the launch monitor 12 is searching for a golf ball. It will be appreciated that more sophisticated lights, lamps, LCD displays, and audible indicators may be used. The housing 14 for launch monitor 12 also contains a user input area 28. In one example, user area 28 has pushbuttons, a keypad, rotary knobs, and other imports to allow the golfer to input user information, or set options for launch monitor 12. Housing 14 may also hold one or more lamps such as lamp 31 and lamp 37. These lamps may be in the visible light spectrum, or may be in another spectrum such as the infrared spectrum. These lamps may be used to provide assistance when ambient light is particularly low, or may be used to facilitate the use of a lower-cost CMOS shutter system. In one construction, the launch monitor is a hinged clamshell housing.

As shown in arrangement 10, the launch monitor is searching for the golf ball 13, but it unable to locate it. Accordingly, the golfer will manually move golf ball 13 to a position more directly in front of sensor 26. As soon as launch monitor 12 determines that golf ball 13 is within strike zone 22 as illustrated in arrangement 11, the indicator lights 24 show that the launch monitor is ready for the golfer to hit the ball. It will be understood that other indicators may be used, such as an audible indicator, to indicate that the ball is in a proper strike zone. Once the ball is in the strike zone, the golfer may launch the golf ball 13 down the driving range. The launch monitor 12 will detect when the golf ball is launched, will measure speed and direction, as well as spin for the golf ball. The launch monitor 12 uses these measurements to present flight path information to the golfer. This flight path information may be visually displayed on display 33, or may be audibly presented on speaker 35. It may also be understood that launch monitor 12 may be set up to indicate general pass or fail indicators according to defined limits for the golfer. In this way, a golfer can receive immediate and simple feedback on the quality of their last swing.

Figure 2:
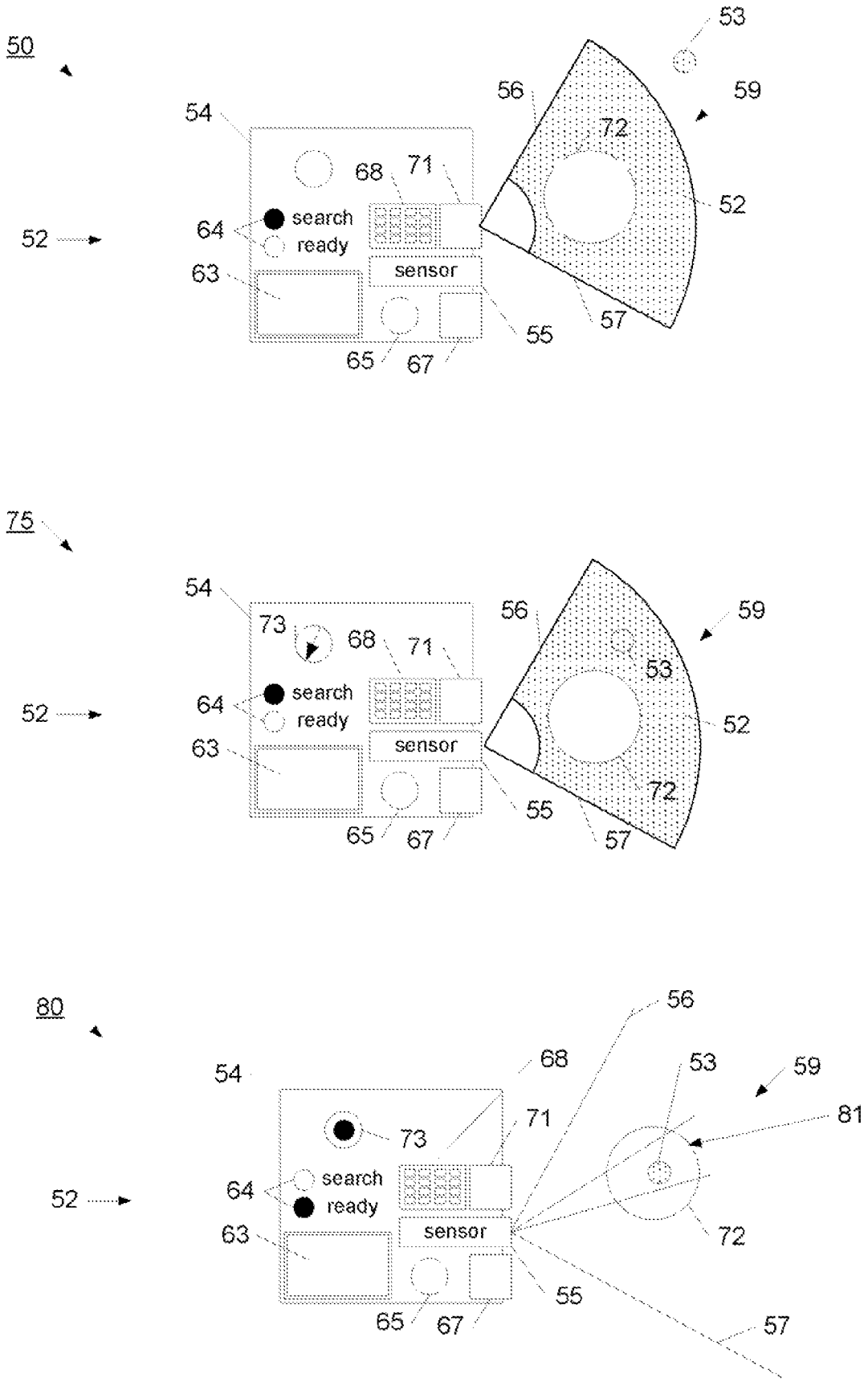
FIG. 2 is an illustration of a launch monitor system in accordance with the present invention.

Referring now to FIG. 2, a launch monitor 52 is illustrated in three different golf ball arrangements. In arrangement 50, launch monitor 52 is illustrated with housing 54 set next to hitting area 59. The housing 54 has indicator lights 64, display 63, speaker 65, lamps 67 and 71, user input 68, as well as sensor system 55. Sensor 55 has view limits as illustrated by lines 56 and 57. Within the view limits, a scan area 52 is provided where the launch monitor 52 may reliably and robustly detect a golf ball. In position 50, golf ball 53 is outside the scan zone, so the launch monitor 52 illustrates it is searching for the golf ball, but has not found it.

Since the launch monitor 52 is searching, the golfer knows to move golf ball 53 closer towards the sensor system 55. As shown in arrangement 75, the golfer has moved golf ball 53 to be within scan area 52. Launch monitor 52 uses sensor system 35 to detect the golf ball 53, and provides algorithmic processes for confidently determining that the object 53 is in fact a golf ball. Once the launch monitor 52 has determined with confidence that the object is a golf ball, the launch monitor 52 uses a directional indicator 73 to assist the golfer in moving the golf ball into a preferred strike zone 72. As illustrated in arrangement 75, the golfer is instructed to move golf ball 53 down and to the left. Although indicator 73 is illustrated as an LED display, it will be understood that LED lamps, or other visual or audio directional indicators may be used. In a particular case, the directional indicators may be used to direct the golfer to place the ball in a strike zone for a left-handed swing or in a strike zone for a right-handed swing. The launch monitor may have an input so the golf may set a preferred swing direction, the monitor may detect a swing direction based on the initial placement of the ball, or may determine the swing direction by locating the club head during address or the swing. It will be appreciated that other processed may be used to determine and set swing direction.

In one example the launch monitor uses just one sensor to locate the golf ball, and to provide placement assistance. Since the sensor only captures a two-dimensional image, and the golf ball must be moved in a three-dimensional space, additional processes are used. In order to determine how far the ball is from the sensor, the image is analyzed to determine the diameter of the ball in the image. Since the golf ball has a known diameter (default value or input by golfer), the distance from the sensor to the golf ball may be calculated. In this process, the launch monitor acquires an image with the sensor, typically at a relatively high resolution, and accurately finds the edge of the golf ball. The diameter is measured, and compared to the actual diameter of the ball. This comparison results in a calculated distance to the ball, that when combined with the regular 2-dimensional coordinate information from the image, may be used to locate the ball in 3 dimensions. With the ball located, the launch monitor is able to provide directional guidance. This distance information may also be useful for configuring the sensors for trigger mode and for capturing the initial image or images. It will be appreciated that multiple sensors may also be used to locate the ball in 3-dimensions.

Following the directional indicator 73, the golfer continues moving the golf ball until a golf ball is within the preferred strike zone 72. In this arrangement 80, the directional indicator changes to indicate that the golf ball is properly placed. In some cases, the indicator or another indicator may show whether a left-hand or right-hand swing is expected. The indicator lights 64 also indicate that the launch monitor 52 is ready for the golfer to strike the ball. More particularly, the sensor 55 has entered a trigger mode where a relatively narrow image zone 81 is used to rapidly monitor golf ball 53. In this way, launch monitor 52 can immediately detect when golf ball 53 has been moved, for example, when struck by the head of a golf club.

Once the sensor 55 has determined that the golf ball has been launched, then additional images are taken, which when compared, enable the launch monitor to determine speed, direction, spin, or other flight path information for the golf ball. This information may then be presented on display 63 or presented through speaker 65. An algorithmic process for determining flight path information is more fully set out in copending U.S. patent application Ser. No. 10/456,054, entitled "Flight Parameter Measurement System", which was filed on Jun. 6, 2003; and in U.S. patent application Ser. No. 10/911,009, entitled "Flight Parameter Measurement System", which was filed on Aug. 3, 2004; both of which are incorporated herein by reference. It will be appreciated that other algorithmic process may be used.

Figure 3:
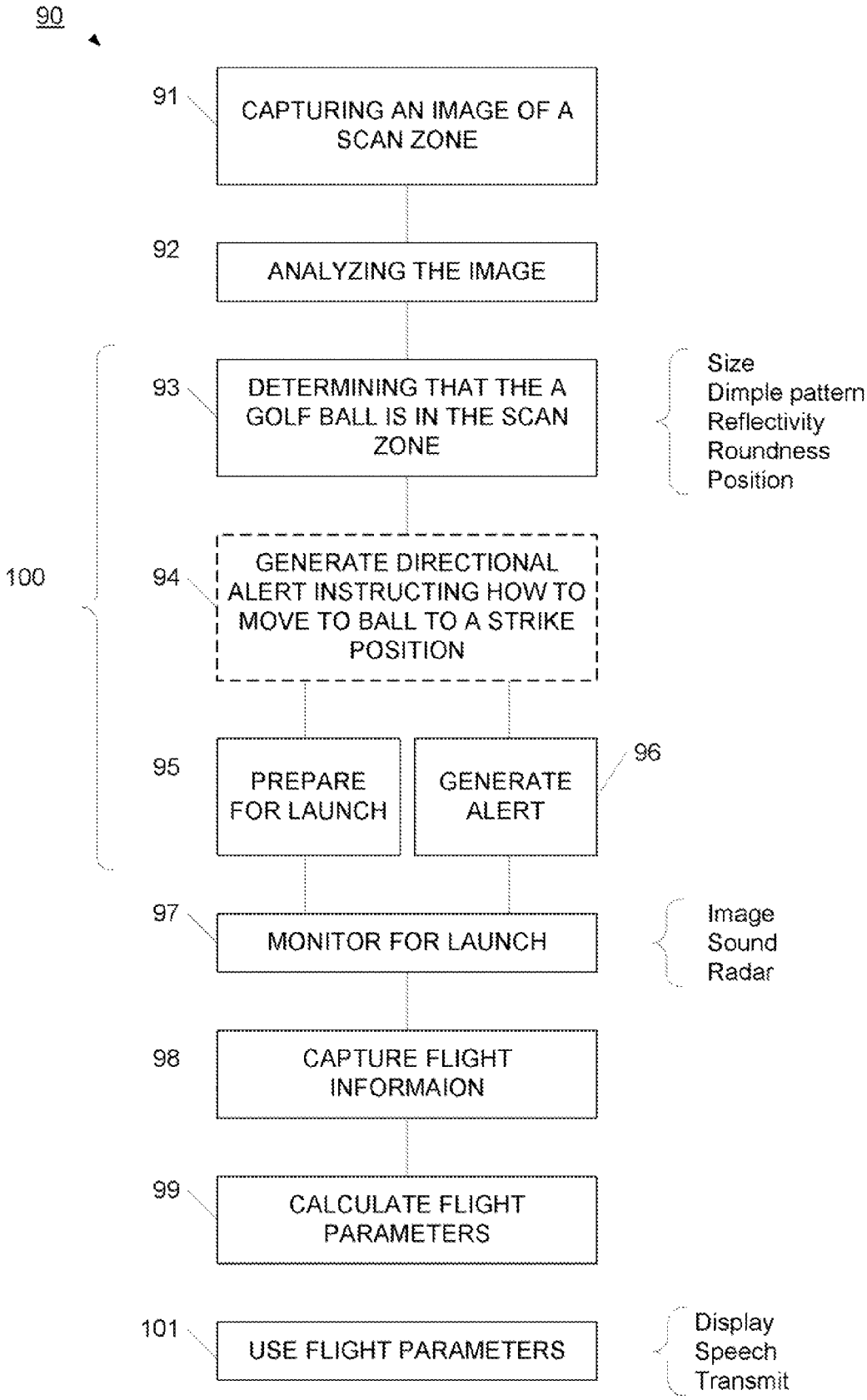
FIG. 3 is a flowchart of a process of using a launch monitor system in accordance with the present invention.

Referring now to FIG. 3, a general process for determining flight parameter information for a golf ball is illustrated. Process 90 has a launch monitor as described with reference to FIG. 2 which captures successive images of a scan zone as shown in block 91. This scan zone is generally a wedge shaped area in front of the launch monitor's sensor. Each image is analyzed for the presence of a golf ball as shown in block 92. Since different types of objects may move through the scan zone, the launch monitor determines if an object is likely to be a golf ball as shown in block 93. For example, the golfer may step into the strike zone, the golfer may place their hand in the strike zone to position a tee, or a leaf or other object may roll through the strike zone. In each of these examples, the launch monitor would detect that an object is moving or has been placed in the strike zone, and determines that each of the objects is not a golf ball. To determine that a discovered object is a golf ball, the launch monitor uses algorithmic processes to confidently analyze any discovered object. For example, the launch monitor has apriori information on an expected size of a golf ball, an expected dimple pattern for a golf ball, the reflectivity ranges for a golf ball, the expected roundness of a golf ball, and the expected position of the golf ball relative to the launch monitor and the ground. Using one or more of these criteria, the launch monitor may confidently and robustly determine that a discovered object is actually a golf ball.

Once the launch monitor has determined that an object is a golf ball, it may optionally generate directional alerts to instruct the golfer how to move the golf ball to a strike position as shown in block 94. These directional alerts will assist the golfer in properly or optimally placing the golf ball for flight measurement. Once the golf ball is in the proper strike zone position, the launch monitor prepares for launch as shown in block 95. The launch monitor may also generate an audio or visual alert to indicate to the golfer that the golf ball is ready to be struck as shown in block 96. In this way, the launch monitor has provided valuable launch assistance 100 to the golfer. This launch assistant 100 not only facilitates rapid setup of the launch monitor, but avoids undue false triggers and excessive resets. In contrast, known techniques require trial and error, measurements aids or hitting several test shots followed by adjustments to establish proper hitting position. The launch monitor then monitors for launch or movement of the golf ball as shown in block 97. For example, the monitor may use the difference between successive sensor images to determine when the golf ball has been moved. However, it is possible that the golf ball may be moved without a proper golf strike launch. For example, the wind may move the golf ball off the tee, or the golfer could accidentally hit the golf ball with the golf club or the golfer may have repositioned the ball after initial placement to a more preferential hitting location. In these cases, the golf ball would be sensed to have moved, but no launch has occurred. This may be accomplished by determining the ball speed—i.e., a ball movement without a club strike will likely be much slower. The system may then reset itself and ready for another sensed ball movement. Alternatively, or in addition, the launch monitor may use other input for determining when a launch has occurred. By way of example, the launch monitor may monitor for the distinctive audible sound of a golf ball being struck, or may use radar feedback to determine that a golf club has moved in to the field at a sufficient speed to strike a golf ball. Provided these other inputs indicate a golf ball strike, and image differences are recognized, then the launch monitor may confidently determine that the golf ball has launched, and proceed to capture flight information as shown in block 98.

Typically, capturing the flight information will entail capturing multiple images, analyzing each image to locate the golf ball, and making comparisons between successive images. More particularly, comparison between high resolution images may be useful for determining how a golf ball is spinning, while comparison of images having relatively low resolutions but at a faster frame rate may be useful for determining speed and direction. In another example, images from both sensors may be used together to determine speed and direction in stereo. Using this speed, direction, and spin information, the launch monitor may use algorithmic processes to calculate and present flight parameter information as shown in block 99. The flight information may be displayed to the user on a display, may be used to drive an audible or speech output, or the flight parameter information may be transmitted to an associated golf simulator or game. In this latter example, the golf launch monitor acts as an input device for a gaming system.

Figure 4:
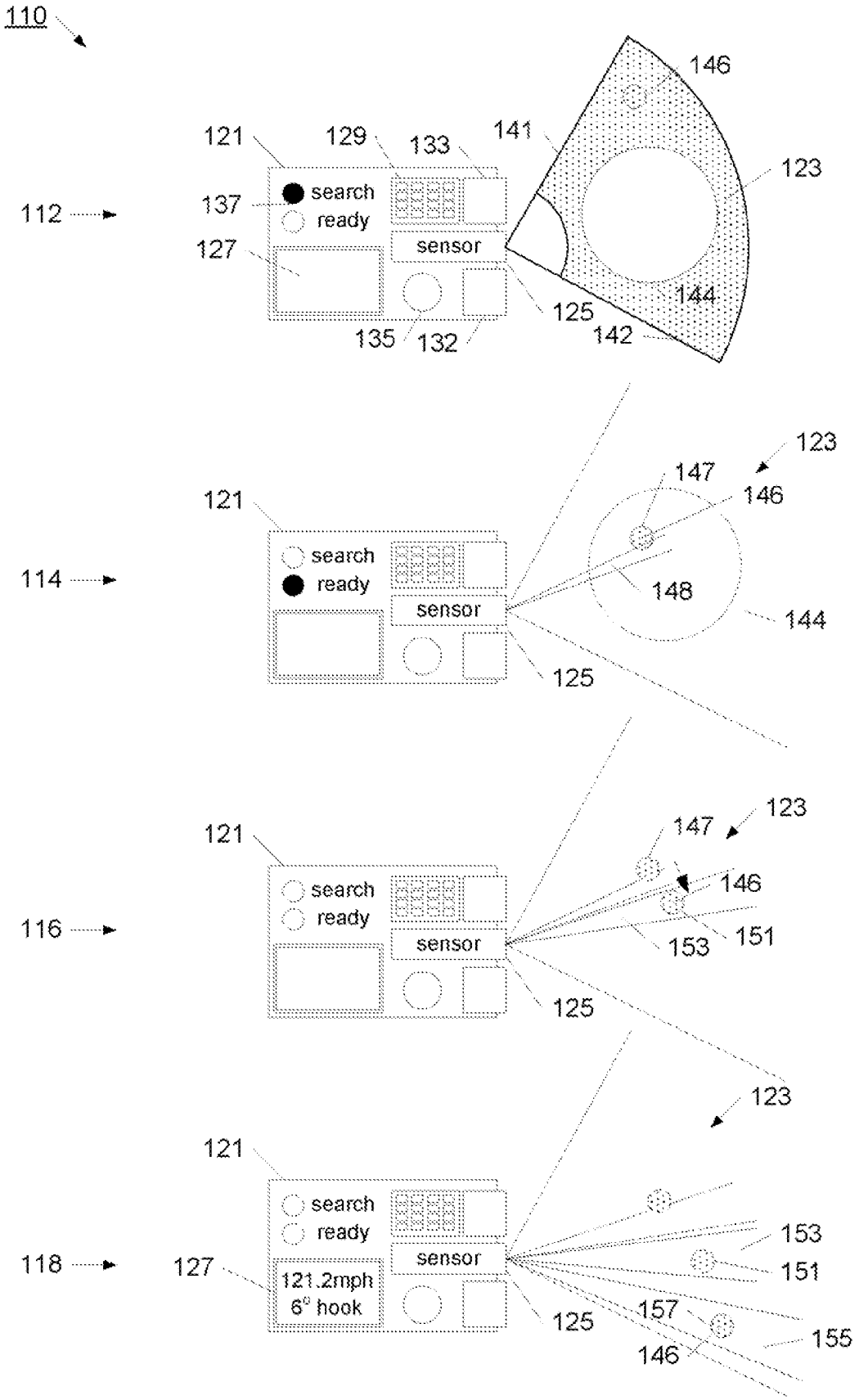
FIG. 4 is an illustration of a launch monitor system in accordance with the present invention.

Referring now to FIG. 4, a launch monitor system 110 is illustrated. In FIG. 4, a launch monitor 121 is shown with four different golf ball arrangements. In arrangement 112, the golf ball launch monitor 121 is set adjacent to a hitting area, and has a field of view defined by lines 141 and 142. Between these lines a wedge scan zone 123 is defined. When golf ball 146 is positioned in the scan zone, the launch monitor 121 may provide directional assistance for assisting the golfer to move the golf ball in to strike zone 144. As with other launch monitors previously defined, launch monitor 121 has indicator lights 137, display 127, speaker 135, lamps 132 and 133, and user inputs 129. Although not illustrated on launch monitor 121, the launch monitor may also have directional indicators or lamps. As shown in arrangement 114, the golf ball has been positioned within the strike zone 144 and the golf ball 146 is ready to be struck by the golfer. Accordingly, the launch monitor 121 has entered a trigger mode, where a relatively narrow field of view 148 has been directed to the golf ball 146. This relatively small field of view enables a very fast frame rate and may be monitored with a relatively low resolution. In this way, comparison of successive images may be rapidly performed, so that movement of the golf ball may be immediately detected. As soon as the golf ball has been struck, as shown in arrangement 116, the trigger window 148 is closed and a first sensor zone 153 is opened.

In arrangement 118, a first image of golf ball 151 is taken. By comparing the time and distance differences between positions 147 and 151, the launch monitor 116 can predict a next position for golf ball 146. In this way, the launch monitor may more precisely open a defined sensor window for taking the next image. By accurately predicting the position of the golf ball, smaller windows may be opened for the sensor, allowing for faster frame rates and higher resolution as compared to non-predicted windows. As shown in position 118, the launch monitor 121 has predicted that golf ball 146 will be within a sensor zone 155. Accordingly, the sensor takes an image which captures golf ball 146 at position 157. In this way, the launch monitor may take higher resolution images of the golf ball, resulting in more accurate flight path information. By taking multiple images, possibly using multiple sensors and at different resolutions, the launch monitor 121 is able to accurately calculate and present flight path information as shown on display 127.

Figure 5:
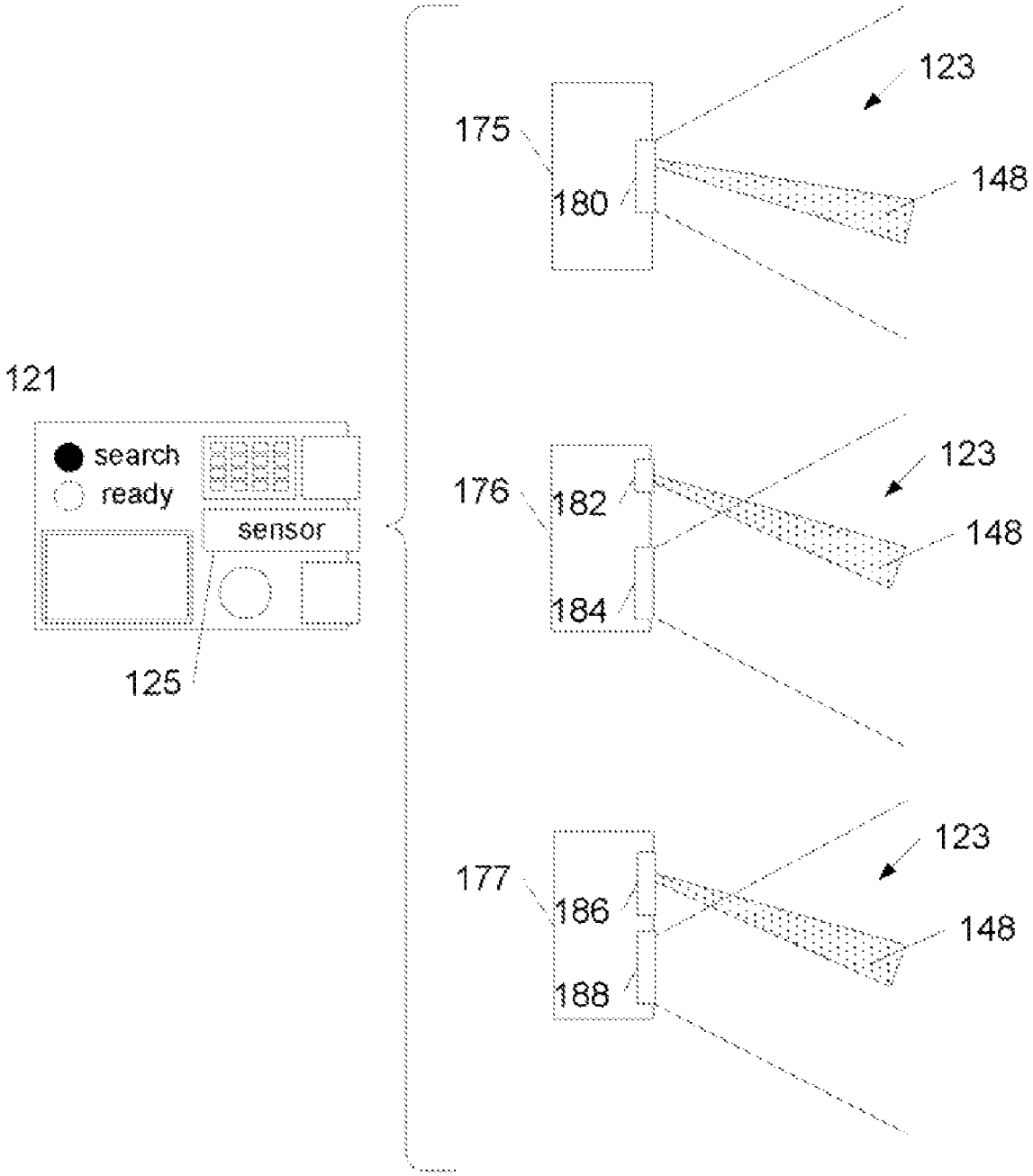
FIG. 5 is an illustration of sensor constructions for a launch monitor system in accordance with the present invention.

Referring now to FIG. 5, an alternative set of configurations for sensor 125 of launch monitor 121 are shown. Launch monitor 121 was illustrated and discussed with reference to FIG. 2, so will not be described in detail here. As shown in FIG. 5, the sensor 125 may be configured as a single CCD or CMOS sensor 180. In this construction, the sensor system 175 has the ability to set different windows in the same sensor 180. For example, the sensor may be set to a relatively wide window view 123, or may have a more narrow view as shown by zone 148. Also, the frame rate may be set differently for the windows. In another construction as shown in example 176, the sensor 125 is comprised of two separate sensors 182 and 184. Sensor 182 may be configured to capture small zone 148, while sensor 184 may be constructed to take images in a larger area 123. Again, each sensor may be constructed to operate at different frame rates and different resolutions dependent on the particular measurements being taken. In another example, sensors 182 and 184 may be differentiated by their frame rates. For example, sensor 184 may be a very high resolution but lower frame rate camera capable of taking images with sufficient quality to enable frame differentiation to calculate spin accurately. In a similar manner, camera 182 may be configured as a relatively lower resolution but much higher frame rate camera capable of taking high frame rate successive images, thereby enabling accurate and efficient calculation of direction and speed. Of course, even in this configuration sensor 182 should have sufficient resolution to determine that the moving object is a golf ball, and to be able to accurately track a ball edge. Because the monitor has previously determined the object is a golf ball, tracking the edge may be accomplished with somewhat reduced resolution or algorithmic processes.

The sensor 182 may be constructed with sufficient resolution to determine that the moving object has a proper reflectivity, color, roundness, or other characteristics for confirming that the moving object is a golf ball. In a final configuration, camera sensor system 177 has two similar cameras 186 and 188. Each of these sensors 186 and 188 may be independently configured for particular functionality. As illustrated, sensor 186 is configured for high frame rate, low resolution sensing into a relatively small area 148, while sensor 188 is configured for relatively low frame rate, high resolution sensing into the larger area 123. It will be appreciated that many other sensor configurations may be used. It should also be apparent that the sensor may operate, for example, as a global shutter or a rolling shutter.

Figure 6:
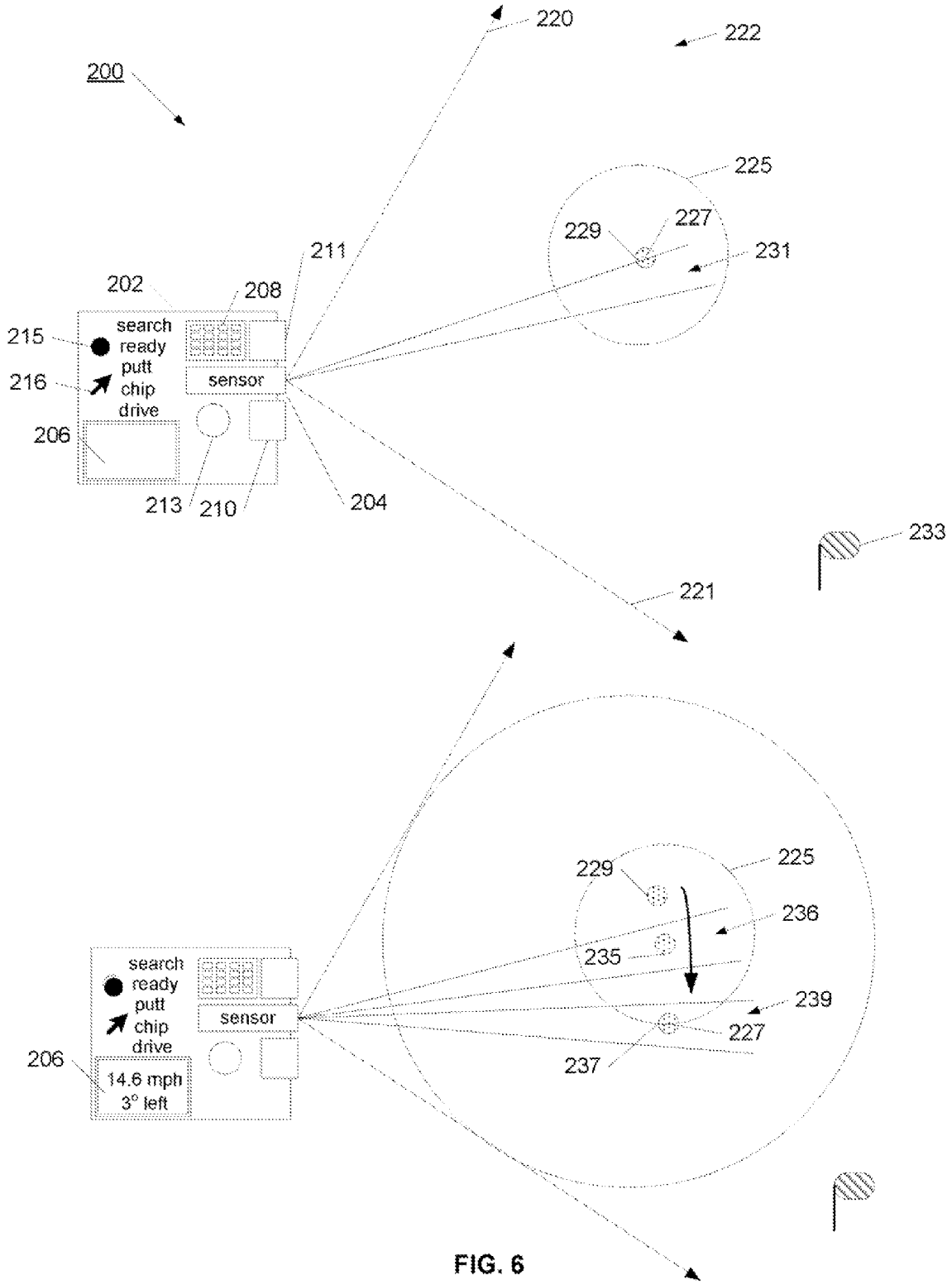
FIG. 6 is an illustration of a launch monitor system in accordance with the present invention.

Referring now to FIG. 6, another launch monitor system 200 is illustrated. Launch monitor 200 has a housing 202 positioned adjacent a hitting area at a golfing area, such as a driving range, chipping area, or putting green. The launch monitor 200 may have controls 216 relating to whether the user is putting, chipping, or driving. As previously discussed, the launch monitor has user inputs 208, lamps 211 and 210, sensor 204, display 206, and indicator light 215. In one example, a golfer may manually set a putt, chip, or drive mode using an input control, and in another example the launch monitor may automatically detect what type of activity the golfer is performing. More particularly, the launch monitor may be able to determine from initial golf ball position, speed, direction, and spin, what type of activity the golfer is undertaking. As illustrated in FIG. 6, a strike zone 225 is defined in the area of view as shown between lines 220 and 221. The golf ball 227 is initially placed at position 229 where the launch monitor detects that a golf ball has been properly positioned to the strike zone. In response, the launch monitor enters a trigger mode and begins a high-speed relatively low resolution monitoring of a small sensor zone 231. By comparing sequential images, the launch monitor may determine when the golf ball has moved. By calculating the speed and direction of the golf ball, the launch monitor may be able to determine if the golf ball movement was due to a putt, a chip, a drive, or an accidental movement. In a case where a putt, chip, or drive has been detected, the launch monitor may apply particular rules and user presets in determining what information to present to the user as flight parameter information. In the case where a false launch has been detected, the unit may reset its trigger mode, and may also provide visual or audible indicators for the user.

In some cases, the launch monitor 202 may be programmed to detect a target 233. In this way, the position of the target may be used to assist in informing the user of how accurately a putt, chip, or drive aligned to a predefined path. This predefined path may be relatively close to the monitor, or may be a target well down the driving range, such as a flag, or a "virtual" target on a golf simulator. The launch monitor may be set to align with this target, and the user may be informed as to how accurately the ball flew toward the target. Another alignment method might be done by placing objects in the field of view of the camera such as two golf balls, a club shaft or other target to allow the system to determine a nominal target direction. After the launch monitor determines its orientation these alignment objects would then be removed from the hitting zone.

When the golf ball is struck, it moves from position 229 to position 235. Position 235 will be an area immediately adjacent the initial stationary position 229 of the golf ball. The launch monitor opens a relatively small window 236 and takes another relatively low resolution high-speed frame. The position and times and distances are compared between position 229 and 235, and a next position for the golf ball is determined. More particularly, the camera may have a predefined frame rate or image timing, and so with the determined speed and direction of the ball can open up an accurate window 239 where the golf ball will be for the next sensor image. In this way, when golf ball 227 is at position 237, the sensor will take another picture. By predicting the position of the next golf ball for each successive image, the windows may be made relatively small, and may be taking at a relatively fast frame rate. This enables more images to be taken, thereby increasing accuracy of speed and direction information. Also, the speed and direction may be used to determine when and where to take a high-resolution image. Again, by defining the likely position of the golf ball, a higher resolution image may be taken, thereby enabling more accurate spin and trajectory information.

The predicted window may be, for example, a capture window for a configurable sensor. In these sensors, selected ranges of pixels may be activated or read, allowing for an image to be taken using only a subset of the available pixels. In another example, the window is a reduced processing window. In this way, a larger or full resolution image is taken, but the processing algorithm operates only on the data in the predicted area. In this way, the launch monitor's processing power is focused on a smaller area of interest, enabling more effective and efficient processing, and likely results in a more accurate determination of flight information. In yet another example, the predictive window may be used to command the sensor to take multiple exposures (i.e., two or more images overlaid on each other) when the golf ball is in a desired location. Using multiple exposures can assist in speeding up the image processing. In yet a further refinement of multiple exposures, one sensor may be used to determine the predicted window and once the golf ball is within that window, the launch monitor can command a second CCD sensor to take a multiple exposure image.

Figure 7:
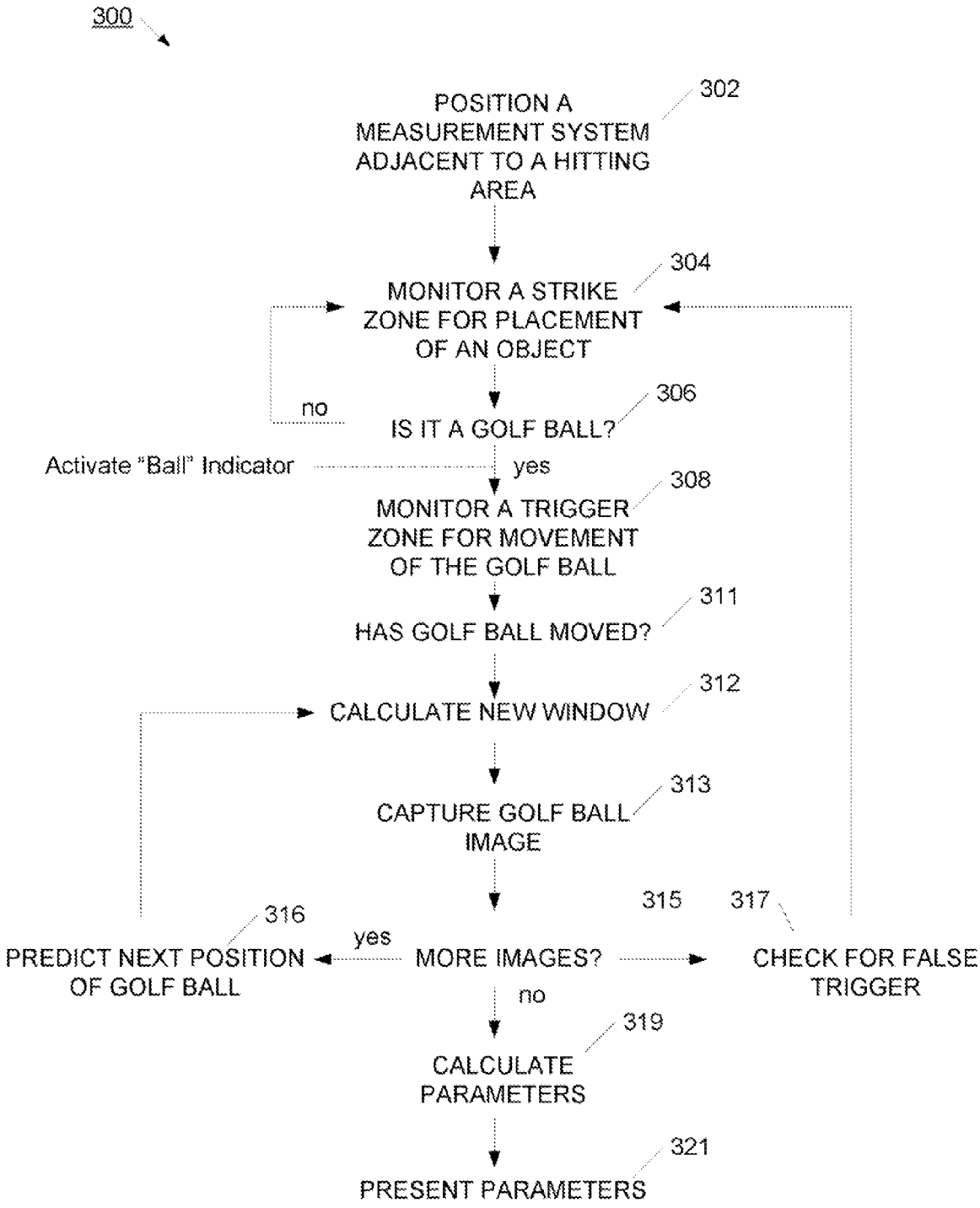
FIG. 7 is a flowchart of a process of using a launch monitor system in accordance with the present invention.

Referring now to FIG. 7, a method of measuring and calculating flight parameter information is illustrated. Process 300 first positions a launch monitor adjacent to a hitting area as illustrated in block 302. The launch monitor monitors a strike zone for placement of an object as shown in block 304. The launch monitor takes a series of sequential images and compares the images to determine if any moving object as a golf ball as shown in block 306. Images are continued to be taken and analyzed until the golf ball is discovered, at which time the launch monitor may activate a ball found indicator. The launch monitor then enters a trigger mode where a small zone is monitored using a high-speed low resolution camera as shown in block 308. More particularly, these successive high-speed frames are analyzed to determine when the golf ball has moved as shown in block 311. If the golf ball has moved, the launch monitor calculates a speed and direction for the ball, and calculates where the golf ball will be at the time the sensor is next activated as shown in block 312. In this way, the sensor is set for capturing a relatively small window, enabling more efficient use of processor, memory, and sensor resources.

A next image is captured as shown in block 313. The launch monitor then determines if more images need to be taken as shown in block 315. For example, the launch monitor may determine that the calculated speed and direction indicate the golf ball is in a flight trajectory, and thereby predicting exposure of the golf ball as shown in block 316. Once the new window has been determined, the window will be opened and the next image captured. However, in the case where the speed and direction indicate a false trigger, then the launch monitor may go through additional processes to further verify that a false trigger has been received as shown in block 317, and thereby reset the monitor for monitoring the strike zone. In some cases, the launch monitor will have taken enough images to allow parameters to be calculated as shown in block 319. More particularly, the images may include images of different resolutions and different frame rates for more effectively calculating flight parameter information. Once potential calculations have been made, the flight parameters may be audibly or visibly presented as shown in block 321.

Figure 8:
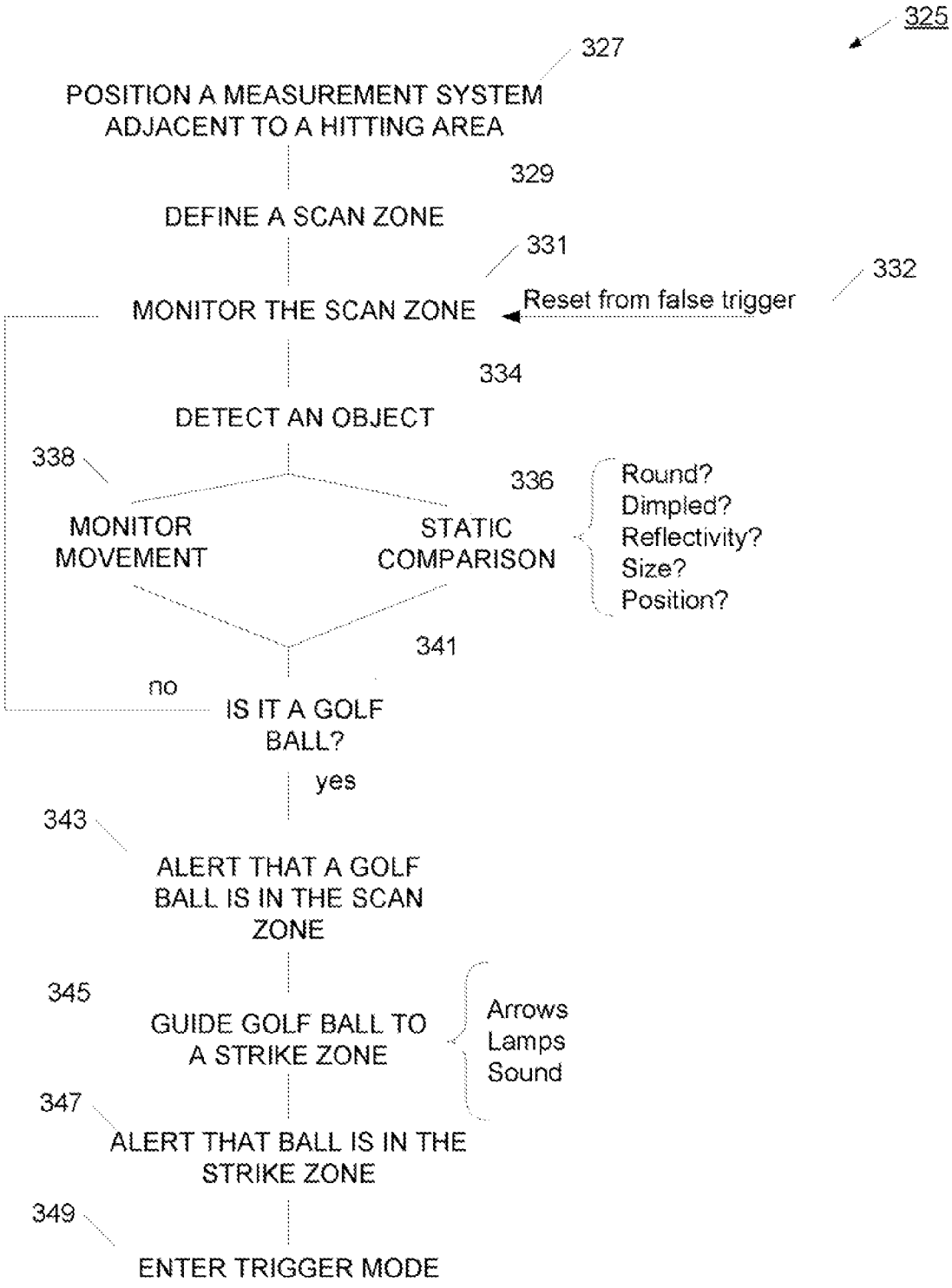
FIG. 8 is a flowchart of a process of using a launch monitor system in accordance with the present invention.

Referring now to FIG. 8, a process for initializing a golf launch monitor is illustrated. Process 325 first positions a launch monitor adjacent to a hitting area as shown in block 327. A scan zone is defined as shown in block 329. In some cases, the scan zone may be a known distance in front of the sensor, while in other cases it may be a more flexible zone defined by current environmental conditions. In this regard, the launch monitor may be able to accurately detect a golf ball in a larger scan zone when brighter ambient light is present, for example. The scanned zone is monitored for an object, in some cases for a moving object as shown in block 324. The detection of the object may include monitoring for object movement as shown in block 338, and may also include a static comparison of the object to characteristics as shown in block 336. For example, the image of the object may be compared to expected roundness, dimple patterns, reflectivity, size, shading, gradients, and position of a golf ball. If the object is determined not to be a golf ball, the launch monitor continues monitoring the scan zone. However, once the object is reliably determined to be a golf ball, the user may be alerted that a golf ball has been found in block 343. The launch monitor thereby knows the position of the golf ball, as well as the preferred strike zone position.

The launch monitor may use directional indicators to guide the golfer to move the golf ball to a strike zone as shown in block 345. These indicators may include arrows, lamps, or audible indicators. Once the golf ball is in the strike zone, an alert may be shown or sounded so that the golfer knows the golf ball is properly positioned. As soon as the golf ball is probably positioned, the launch monitor may enter a trigger zone as shown in block 349. More particularly, the launch monitor may open a high-speed low resolution window to monitor for when golf ball movement is found.

Figure 9:
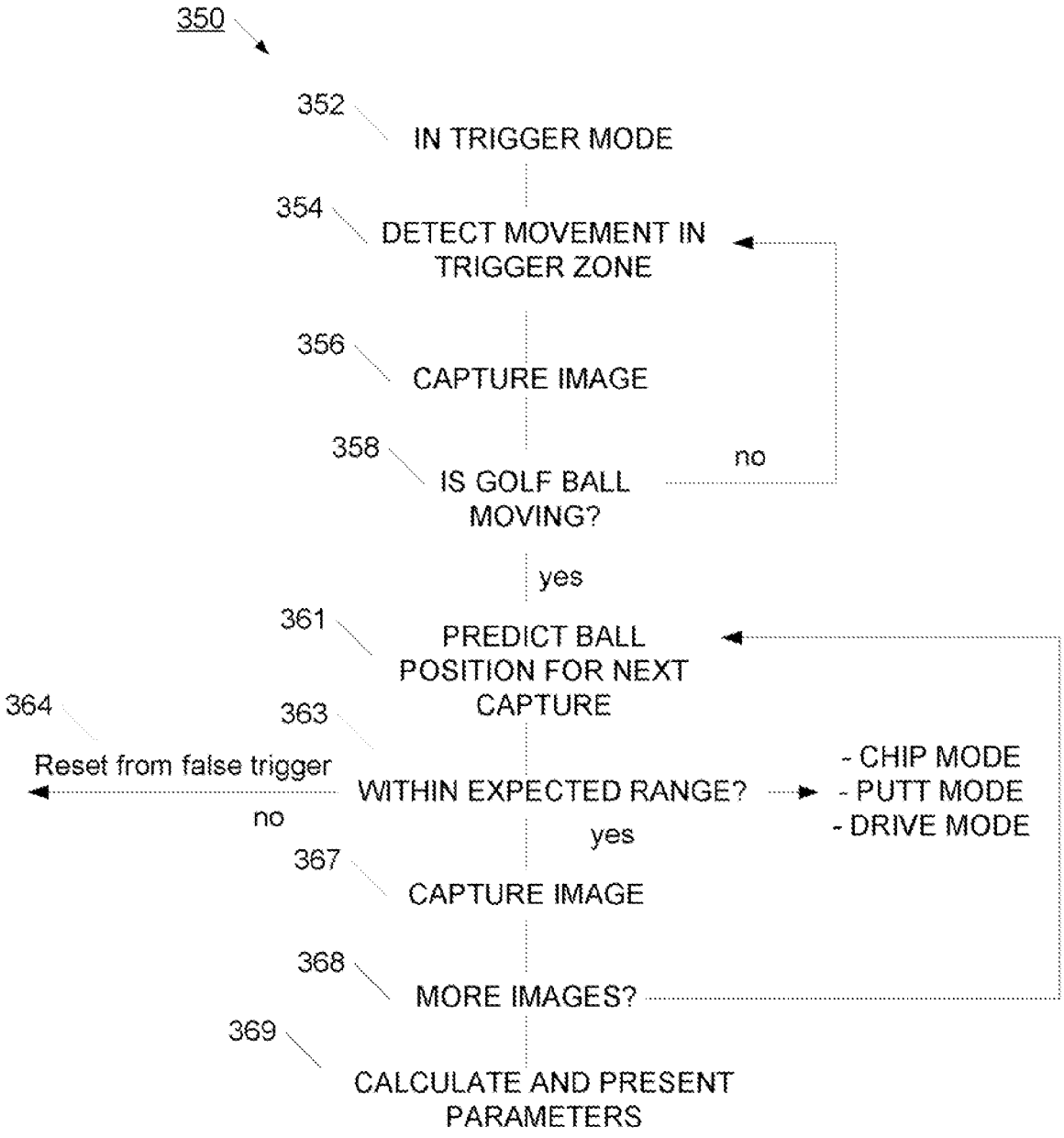
FIG. 9 is a flowchart of a process of using a launch monitor system in accordance with the present invention.

Referring now to FIG. 9, a method of calculating and presenting flight parameter information is illustrated. Process 350 has a launch monitor that is in a trigger mode. More particularly, the launch monitor is monitoring sequential images for movement of the golf ball. As soon as movement is detected as shown in block 354, a next image is captured as shown in block 356. By comparing these images, it may be determined if the golf ball is actually moving, or if a false trigger has been detected. If the golf ball has not moved sufficiently, then additional images may be taken to detect an initial motion. However, if the golf ball is moving, then the launch monitor may predict the next position of the golf ball as shown in block 361. If this predicted position is within an expected range, then the launch monitor may further determine whether the strike was a chip, a putt, or a drive. In response to this decision, the launch monitor may use the specific criteria for calculating flight parameters, as well as applying different formatting rules to parameter presentation. The launch monitor will then capture an additional image as shown in block 367, and continue capturing more images as shown in block 368 until sufficient images have been captured to accurately calculate flight parameters as shown in block 369. If the speed and direction of the ball indicate the ball has not been hit, then the system may reset as shown in block 364.

Figure 10:
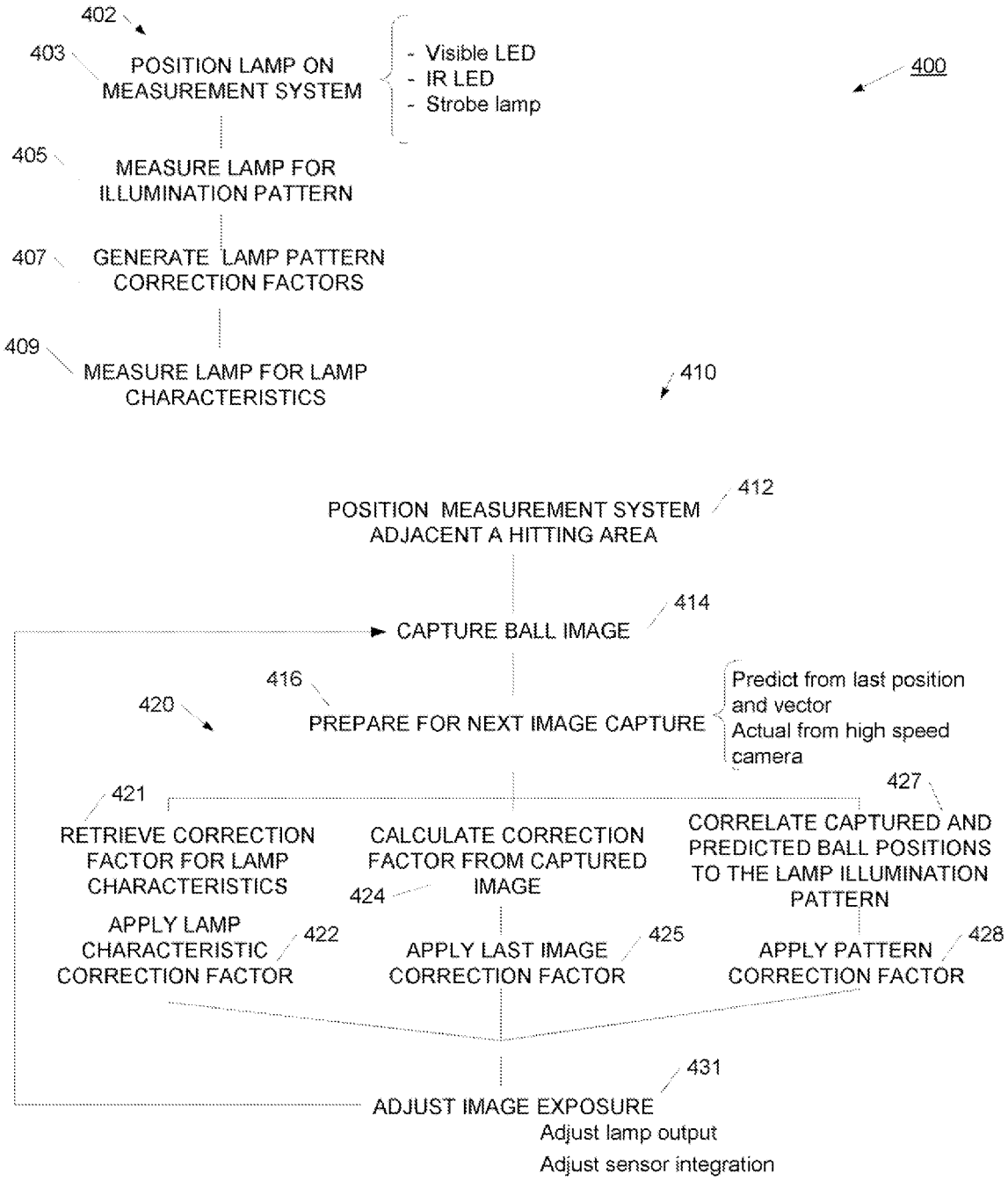
FIG. 10 is a flowchart of a process of using a launch monitor system in accordance with the present invention.

Referring now to FIG. 10, a system for lamp management 400 is illustrated. System 400 has an initialization process 402 where one or more lamps are positioned on the launch monitor as shown in block 403. These lamps may be visible light LEDs, infrared LEDs, or a strobe lamp. The lamps are illuminated and the lamp pattern is measured as shown in block 405. For example, many lights have different illumination patterns over its illumination range, and may have different illumination characteristics depending upon temperature, duty cycle, and battery voltage. In this way, the measurement of the lamp illumination pattern may include not only three-dimensional analysis of illumination patterns, but may include analysis of temperature, voltage, and age-related characteristics. Based on these known measured characteristics of the lamp, lamp correction factors may be generated as shown in block 407. These lamp correction factors are then stored as shown in block 409. These correction factors may be generated in real-time and may be used by the launch monitor to adjust the images obtained, increasing image processing efficiency and accuracy.

At a later time when the launch monitor is being used as shown in process 410, the launch monitor is positioned adjacent the hitting area as shown in block 412. An image of the ball is captured as shown in block 414. As described previously the launch monitor prepares the sensor for the next image capture. In this regard, the launch monitor may predict from the last position and speed and direction information where the golf ball will be at the next sensor image time. In another example, another sensor may be used to determine precisely where a golf ball is, and this location information used to set the first sensor for taking a next image. Since the launch monitor has predicted or determined where the golf ball is for the next image, the launch monitor may retrieve correction factors for lamp characteristics as shown in block 421, and apply these lamp characteristic correction factors as shown in block 422. For example, if the golf ball is in a particularly dark area of the lamp's illumination pattern, the sensor may use a longer integration time for taking the picture. In another example, if the lamp has been on for an extended period of time, it may be at its maximum brightness and therefore the integration time may be reduced. This information may then be used to adjust the image exposure as shown in block 431, so that the next image may be more accurately taken.

In another example, the launch monitor may use information from a previous image to apply a correction factor as shown in blocks 424 and 425. For example, a previous image may be analyzed to determine that the golf ball is too bright, and therefore the image may be adjusted to have a shorter integration time for the next image. Accordingly, the image exposure is adjusted as shown in block 431. In a final example, the lamp illumination pattern may be further used to more accurately determine golf ball position. For example, the captured image of the golf ball may have reflected pattern information for the lamp. This pattern information may be correlated to the known positions of the lamp pattern, and thereby used to more accurately position the golf ball. Again, by more accurately determining the position of the ball, proper correction factors may be applied as shown in block 428.

Figure 11:
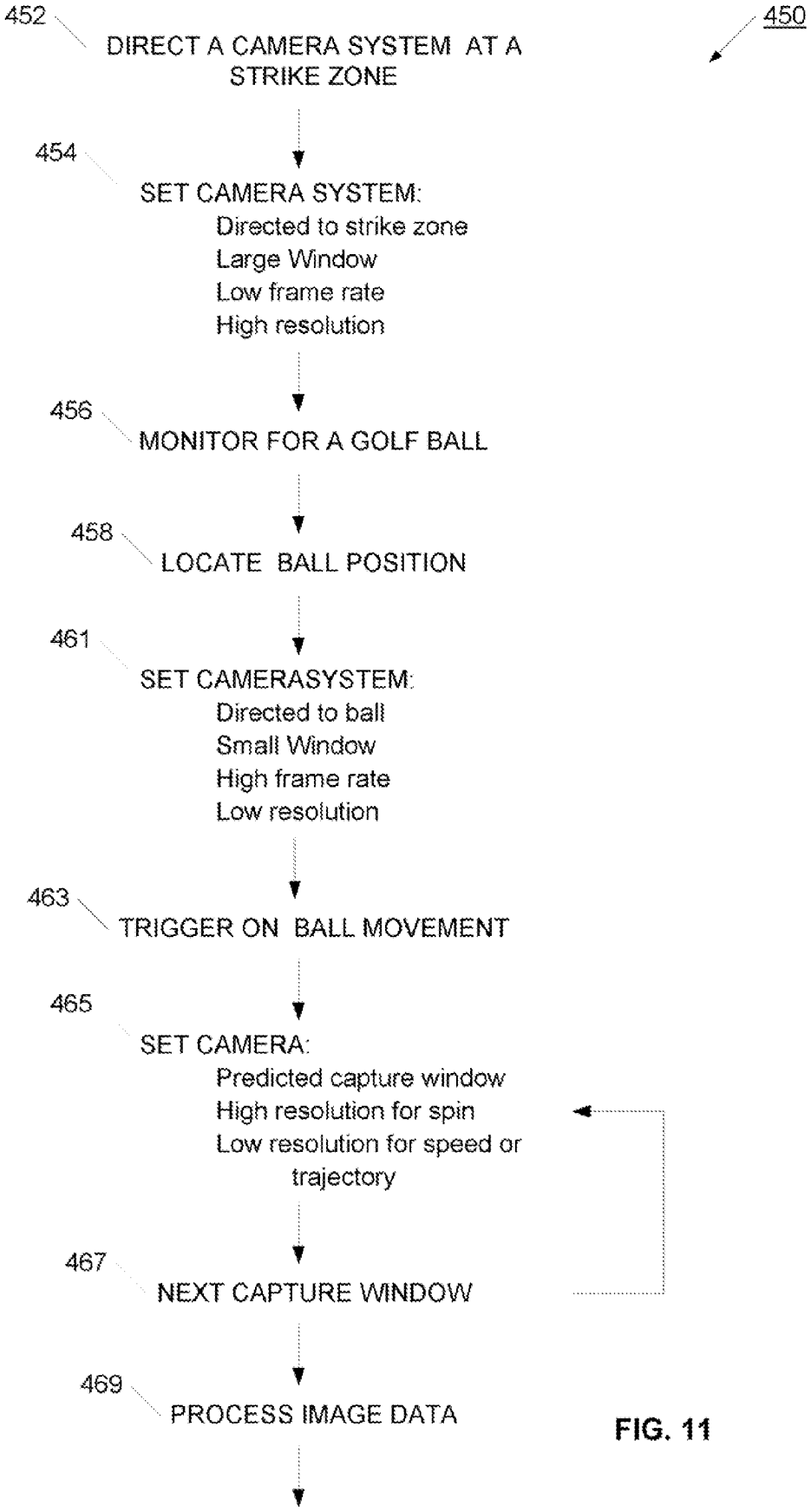
FIG. 11 is a flowchart of a process of using a launch monitor system in accordance with the present invention.

Referring now to FIG. 11, a method for configuring a sensor system is illustrated. System 450 has a camera system directed at a strike zone as shown in block 452. More particularly, the camera system is typically a CMOS or CCD sensor positioned on a launch monitor. The launch monitor first sets the sensor system to view a relatively large area, such as a scan area as shown in block 454. This scanning may be done, for example, using a large high-resolution window operating at a relatively low frame rate. In this way, the algorithmic processes may be used to accurately and robustly determine that an object is actually a golf ball. By analyzing one or more images it may be determined that a golf ball is in the scan or strike area as shown in block 456. The launch monitor accurately determines the ball position as shown in block 458, and then enters a trigger mode. In trigger mode as shown in block 461, the camera opens a relatively small high frame rate window which may operate at a low resolution. This camera may be the same sensor as previously used with just different configuration settings, or may be a different sensor system. The camera system operates at a relatively low resolution, but the resolution is still sufficient to be able to determine a ball edge. In this way, it may be accurately determined when the ball leaves the initial location.

The launch monitor triggers upon detecting ball movement as shown in block 463. Once movement has been detected, the camera takes an initial image and uses that image to predict the next capture windows. In one example the first capture window is predicted based upon whether a left or right-handed golfer is using the device. The left-handed or right-handed condition may be manually set by the user, or may be detected by direction of golf swing—i.e., the presentation of the golf club head could be used to predict the direction of the ball movement. In another example, the physical orientation of the launch monitor housing may be detected to set the direction of swing. The camera may be set according to whether the image is intended to be used in determining speed or whether the imaging is to be used in determining spin. For example, spin calculations require much higher resolution images than images for determining speed and direction. Accordingly, as shown in block 465, the launch monitor may predict capture windows for both a high resolution image and low resolution image. Based upon the speed and direction of the ball, additional capture windows are defined as shown in blocks 467, as additional images are captured, their process as shown in block 469. Some calculations may be done in real time to facilitate a next image capture, while more complex algorithmic processes may be delayed until all images have been taken. Although these descriptions generally discuss "high" and "low" resolutions, it will be understood that the resolution of the sensors may be set according to application needs and available sensors. For example, as the cost of sensors drops and resolutions increase, both sensors may be high resolution/high frame rate sensors.

Figure 12:
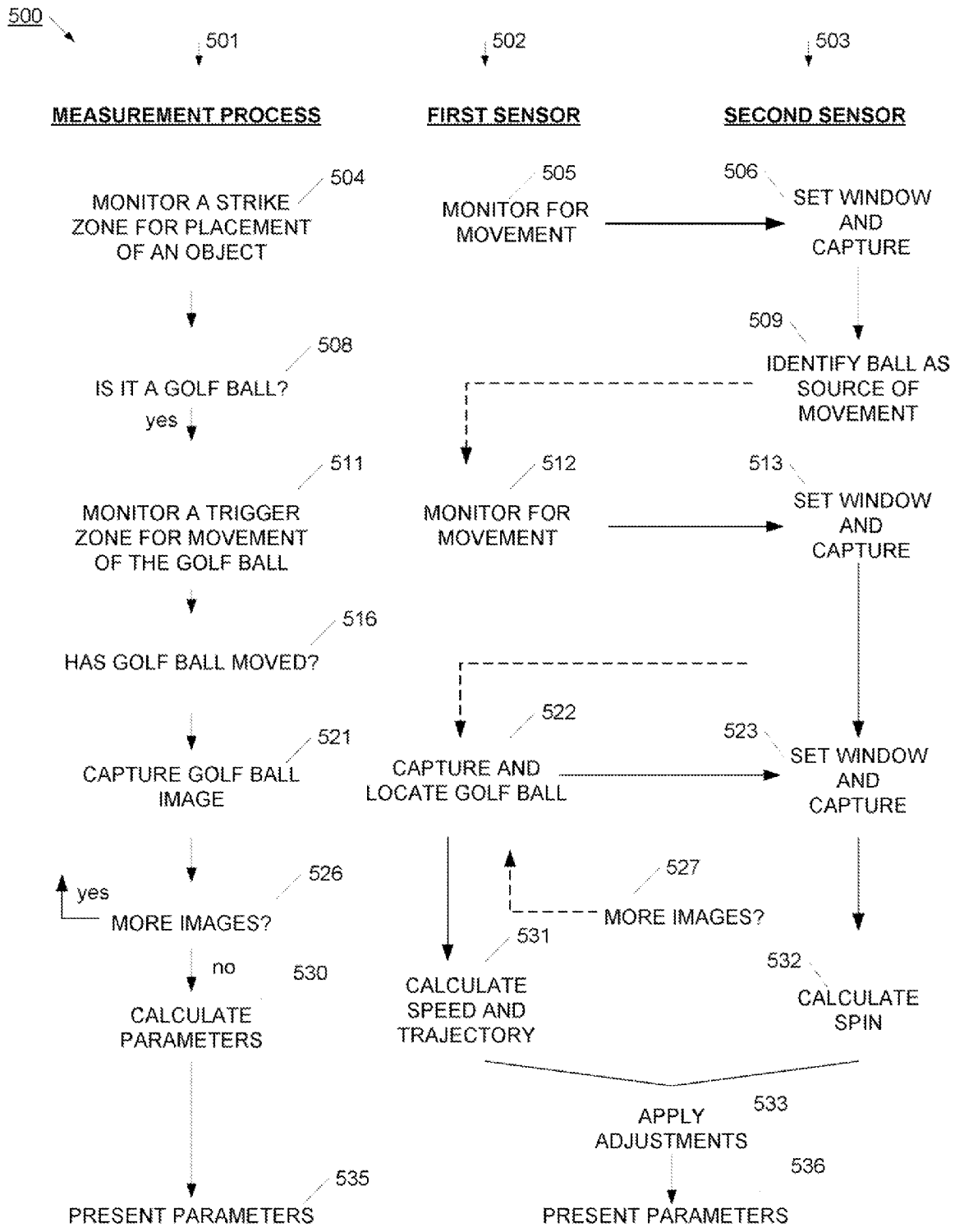
FIG. 12 is a flowchart of a process of using a launch monitor system in accordance with the present invention.

Referring now to FIG. 12, a method of operating a multi-sensor launch monitor is illustrated. Process 500 generally has a measurement process 501 similar to measurement process 450 described with reference to FIG. 11. FIG. 12 also describes first sensor functions 502 and second sensor functions 503. It will be appreciated that first and second sensors may be different windows in the same physical sensor, or may be separate physical camera or sensor systems. As the launch monitor monitors a strike zone for placement of the object as shown in block 504, the first sensor may be used to monitor for movement as shown in block 505. Responsive to detecting movement in the scan area or strike area, the first sensor may cause the second sensor to be configured to capture a high-resolution image of the moving object. In this way, the first sensor is used to detect and locate an object generally, and the second sensor is used to take an image to more particularly identify the object. Based upon this more high-resolution image, the launch monitor may identify the object as a golf ball as shown in block 509. With the object identified as a golf ball 508, the launch monitor now enters a trigger mode as shown in block 511. In this case, the first sensor may be set to a high-speed low-resolution sensing mode as shown in block 512 for monitoring for movement. As soon as movement is detected, the second sensor may be set to capture an image of the ball as shown in 513. In some cases, this image may be a high-resolution relatively low-frame rate image for calculating spin. In other cases, this window may be a high-speed lower-resolution image to assist in calculating speed and direction parameter information.

Once it has been determined that the golf ball is in flight as shown in block 516, then successive or sequential images of the golf ball are captured as shown in block 521. More particularly, the first sensor may be used to capture a sequence of images useful for calculating direction and speed information as shown in block 522, and also used to define and set a window of the second sensor as shown in block 523. The second sensor may be a CCD that is configured to take a multiple exposure image(s). The images captured by the second sensor may then be a high enough resolution to accurately and robustly calculate spin as shown in block 532. Additional images are taken in block 526 until a sufficient number of images have been taken. Parameters are then calculated as shown in block 530 which may include using the first sensor images for calculating speed and trajectory, and the second sensor images for calculating spin. Any adjustments may be applied as shown in block 533, and the parameters presented as shown blocks 535 and 536.

Figure 13:
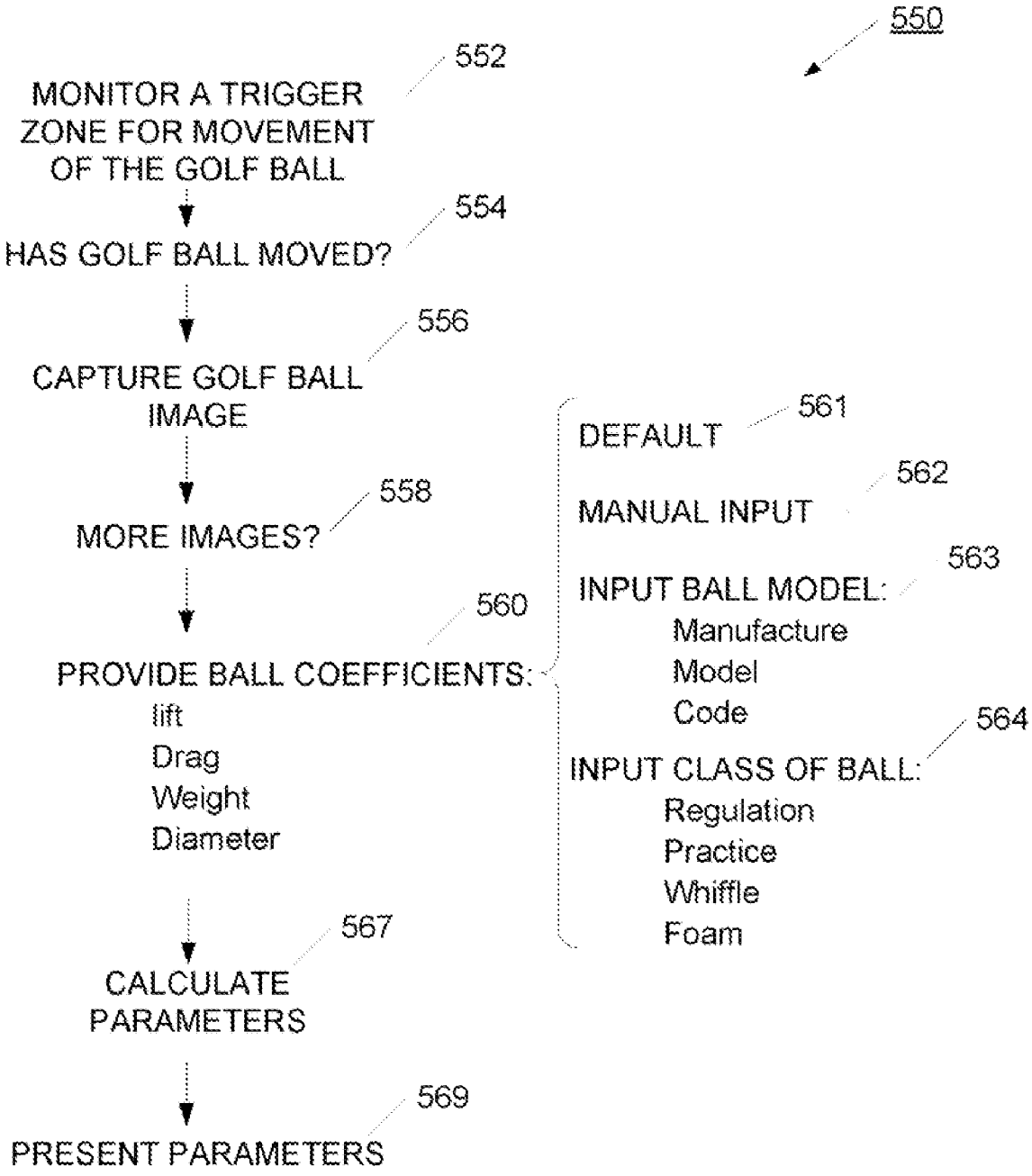
FIG. 13 is a flowchart of a process of using a launch monitor system in accordance with the present invention.

Referring now to FIG. 13, an adjustment process 550 is illustrated. Process 550 advantageously enables a golfer to strike a first golf ball, but receive flight path information as if they had hit a different ball. In process 550, a launch monitor monitors a trigger zone for movement of a golf ball as shown in block 552. When the golf ball has moved as shown in block 554, the image of the golf ball is taken as shown in block 556. Additional images are taken as shown in block 558. Once sufficient images have been taken to calculate speed, direction, and spin, the launch monitor applies algorithmic processes, which includes golf ball coefficients as shown in block 560. These golf ball coefficients typically include information regarding lift, drag, weight, diameter and moment of inertia. These golf ball coefficients may have a default setting as shown in block 561, or may be manually input or changed by the user as shown in block 562. In some cases, the launch monitor or a database accessible by the launch monitor may have golf ball coefficients assigned according to a ball model as shown in block 563. In this way, a golfer may simply input the manufacturer, model, and code for a particular golf ball, and the launch monitor will load the proper ball coefficients for that ball.

In another example, the golfer may input the type of ball more generally as shown in block 564. In this case golf balls are divided into particular classes, and typical numbers assigned for the class. Some classes may include regulation balls, practice balls, whiffle balls, and foam balls. It will be understood that other types of classifications may be made. Depending on the ball coefficients for the actual ball hit, the golf ball monitor may calculate parameters as shown in block 567. These calculated parameters may compensate for the differences in the ball coefficients of the ball actually hit as compared to a typical regulation ball. In this way, the golf ball monitor may present parameters as if the golfer hit a regulation ball as shown in block 569.

In a specific example, a golfer places a whiffle ball in front of a launch monitor and instructs the launch monitor that a whiffle ball is being used. The golfer hits the whiffle ball, propelling the whiffle ball 50 or 60 feet in a backyard area. However, the launch monitor uses the lift, drag, weight, and diameter information of the whiffle ball to generate correction factors for the practice hit. In this way, the launch monitor may be able to present flight path information showing that, had the golfer hit a regulation ball, the ball may have flown several hundred yards. In this way, a golfer may be able to use practice or alternative balls and still receive consistent information according to the way a regulation golf ball would have flown.

Figure 14:
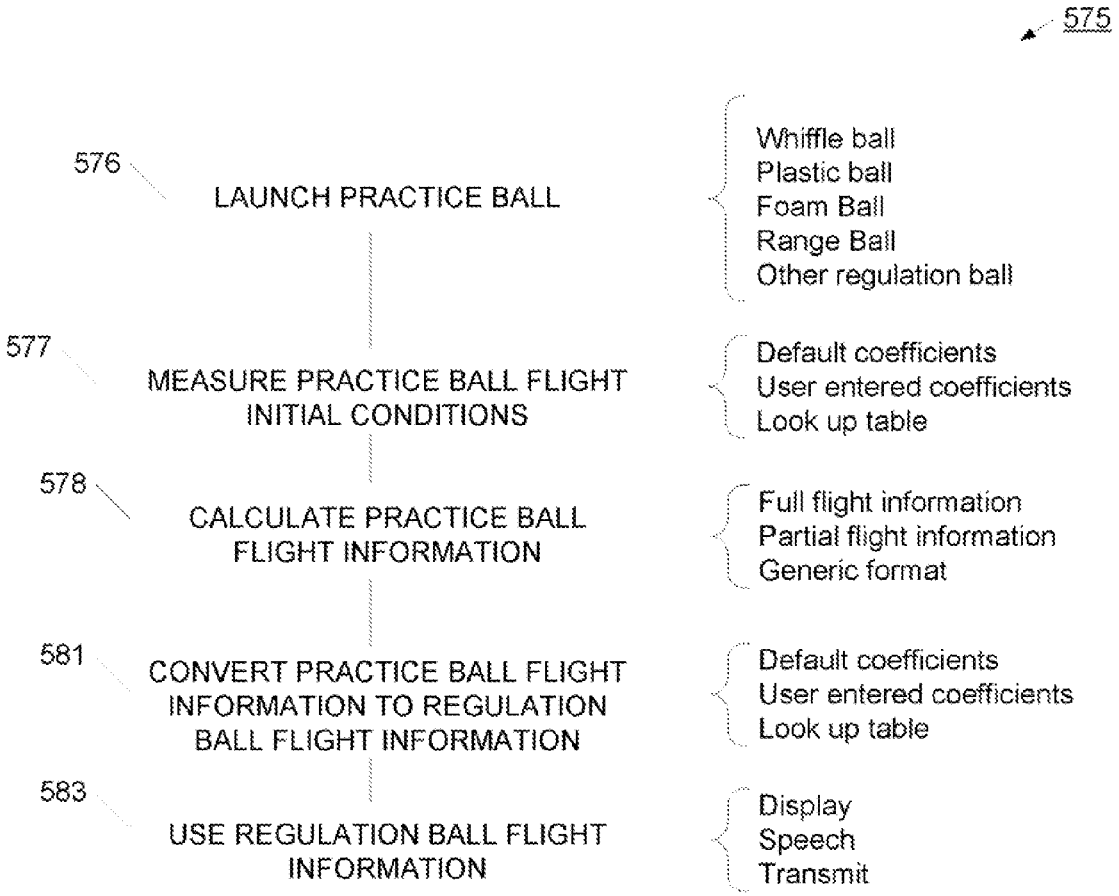
FIG. 14 is a flowchart of a process of using a launch monitor system in accordance with the present invention.

Referring to now to FIG. 14, a method of using practice balls is illustrated. Method 575 has a golfer launch a practice ball as shown in block 576. This practice ball may be for example a whiffle ball, a plastic ball, a foam ball, a range ball, or a different regulation ball than the golfer normally uses. The launch monitor has a set of coefficients for the launch practice ball as shown in block 577. These coefficients may be default, but are more likely entered by the user or provided through a lookup table, which may be stored within the launch monitor or accessible through some wired or wireless connection. Based on the coefficients for the practice ball, the actual practice ball flight information is calculated as shown in block 578. This may include the full flight information, or may be only the essential partial flight information. In another example, the flight information may be presented in some generic format for consistent conversion.

The launch monitor also has information regarding the preferred regulation ball of the golfer as shown in block 581. The regulation coefficients may be set by default, or more likely are set by the user or provided through a lookup table. The launch ball monitor uses the information of the preferred golf ball to then calculate how the regulation ball would have flown had it been hit like the practice ball as shown in block 583. This information may then be put on the display, may be presented to the user as a speech or other audible display, or may be transmitted to a simulator or gaming machine.

Figure 15:
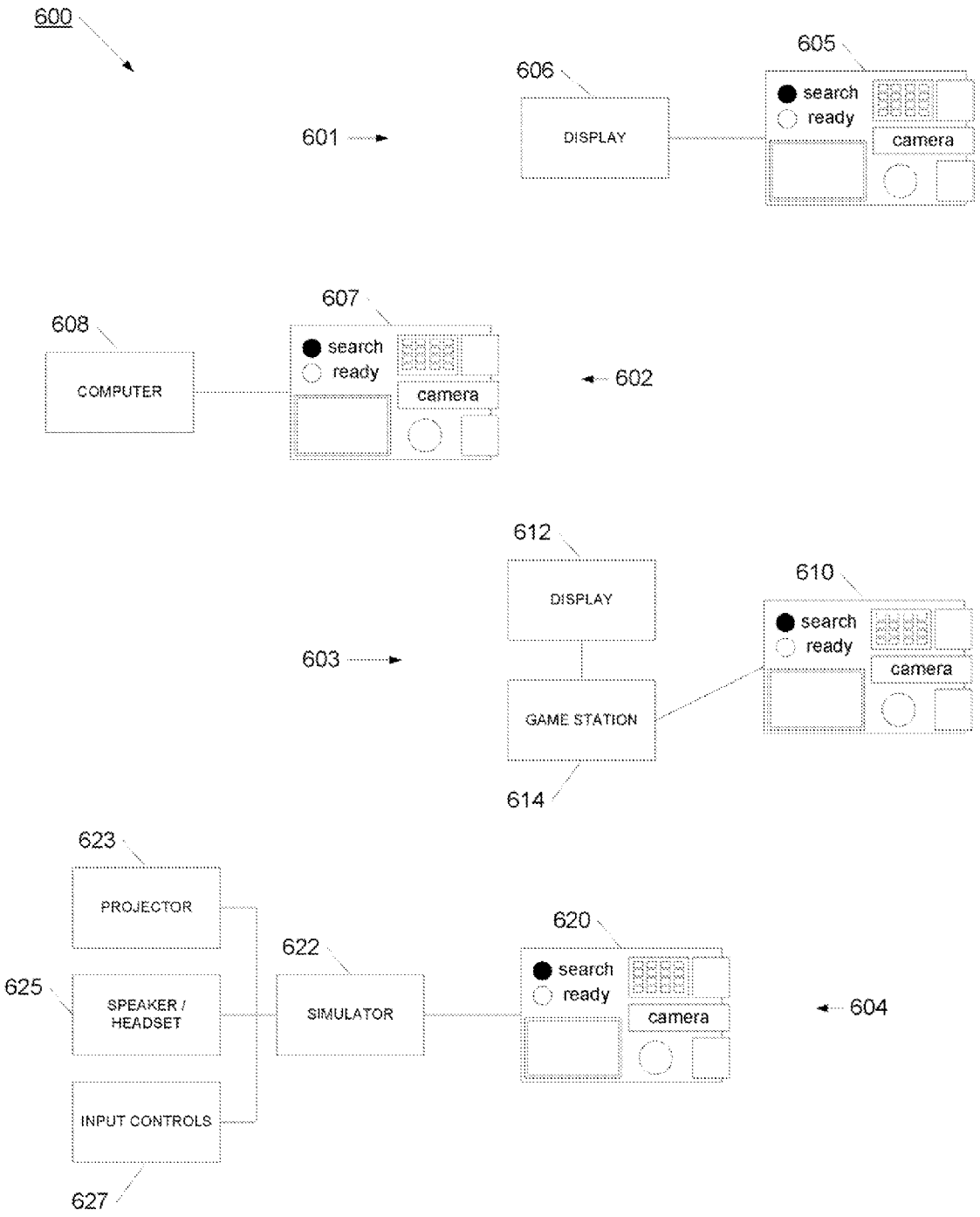
FIG. 15 is a flowchart of a process of using a launch monitor system in accordance with the present invention.

Referring now to FIG. 15, a golf ball gaming system 600 is illustrated. In system 600, a launch monitor is shown in different configurations for a gaming system. In configuration 601, a launch moderate 605 has an external display 606 for displaying flight parameter information or gaming information. For example, the launch monitor 605 may have built in gaming applications which can be presented to larger display 606. In this way, the connection on display 606 to launch monitor 605 operates as a golf simulation game. In another example, the launch monitor 607 is connected to a computer system 608. This configuration 602 has the launch monitor 607 passing flight parameter information to computer 608, where computer 608 can further analyze the information for technical analysis, or may use the information as part of a game simulator. It will be understood that computer 606 may have additional peripherals such as speakers, displays, or other peripherals.

In another configuration 603, a launch monitor 610 is connected to a game station 614. A game station may be for example, a standard gaming console, or a computer system. In another example, the game station is a portable device for use on the driving range. The game station 614 has a display 612 for providing additional entertainment or informational displays. In a final configuration 604, a launch monitor 620 is connected to a golf simulator game 622. The golf simulator 622 typically has a projector 623 for projecting a large image of a simulated golf course, has speech or headset audible output 625, and also has input control 627 to allow a golfer to make game selections. For example, a golfer may simulate playing a particular famous golf course or famous hole, where the simulator 622 presents the simulated golf course on projector 623. Then, as the golfer hits golf balls using launch monitor 620, the flight parameter information is passed from launch monitor 620 to the simulator 622. The simulator 622 calculates where the golf ball would have landed on the course, and projects the golf ball flying and landing appropriately using projector 623. Based upon the course position, the golfer makes club selection, which may be set through input control 627, and takes a next swing using launch monitor 620. In this way, a more enjoyable golf simulation experience may be enabled.

In another example of using the launch monitor, the launch monitor is an input device for a club fitting system. In a fitting system, a golfer tries several clubs, in several configurations, to find a club that is comfortable and provides a solid, straight shot with the maximum and/or desired distance. Typically, the golfer swings each club multiple times to understand how the club is performing. The launch monitor enables a golfer to efficiently try new clubs, and to receive immediate information as to the quality of each shot. In particularly advantageous feature, the golfer does not have to configure the launch monitor for each club or shot, but can simply place the ball, select any club, and swing. The launch monitor automatically adapts to any club, any ball, or any swing style.

In a further refinement, each club in the set of available trial clubs is identified with a bar code. The bar code has a number that identifies the club number, shaft length, shaft style, manufacturer, model number, and other club information. This information may be coded into the bar code label, or may be retrieved by association the barcode number with information in a local or remote database. The sensor for the launch monitor has additional application code that allows the sensor to locate and read a bar code label. In this way, the sensor on the launch monitor acts as the bar code reader, so that club information may be automatically recorded. This is very convenient, and improves the accuracy of recording club usage.

To use the bar code system, the golfer selects a coded club. The bar code is typically attached to the hosel, head, or heel of the club. The golfer places a ball, and swings the club. During the swing, the sensor takes an image of the bar code, and decodes the bar code data. The image may be taken, for example, after the ball has been launched from the tee. Since the ball exits much faster than the club head, the sensor has sufficient time to capture an image before the club leaves the field of view. Provided the bar code has been properly placed on the club, the bar code can be read, decoded, and the club information recorded or otherwise used. In another example, the golfer places the club in front of the sensor, and the sensor detects and reads the barcode. This more static reading process could be done prior or after taking a shot.

Figure 16A:
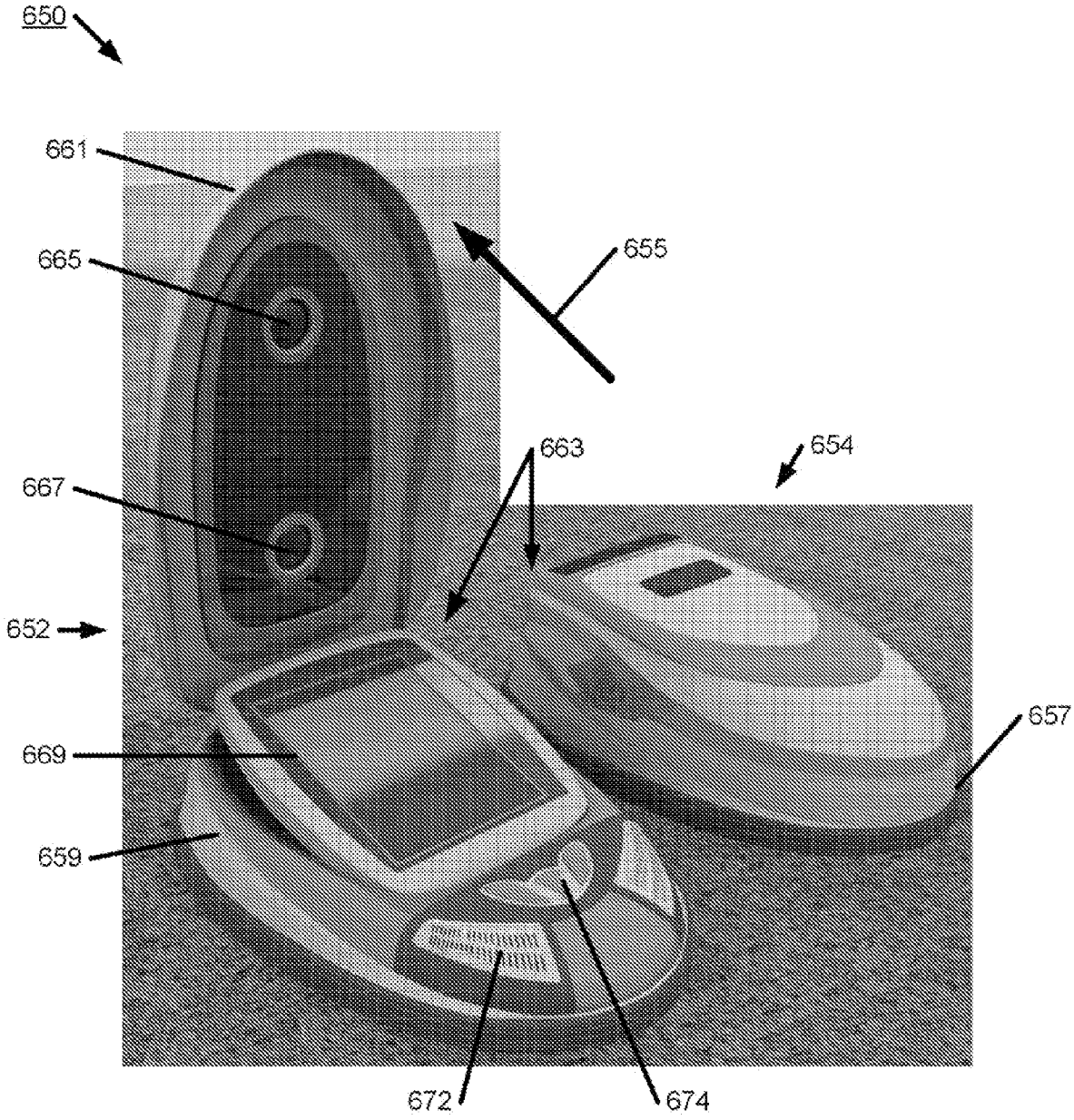
FIG. 16A is an illustration of a launch monitor using a foldable construction in accordance with the present invention.

Referring now to FIG. 16A, a foldable (also referred to herein as a clamshell) launch monitor 650 is illustrated. Clamshell monitor 650 has a bottom housing 659 that is hinged 663 (not visible) to a top housing 661. Clamshell monitor 650 is shown in an open position 652, and in a closed position 654. Clamshell monitor 650 is advantageously sized and shaped for ease of use and setup by a golfer. For example, the clamshell monitor 650 conveniently folds to position 654 to protect sensitive sensors, controls, and displays. The clamshell monitor 650 collapses to a size that may be readily placed in a typical golf bag, or safely stowed in a golf cart. Also, since the clamshell monitor 650 may be powered by batteries, it may be used at any location, irrespective of the availability of other power. When in its open position 652 the clamshell monitor 650 conveniently allows access to user controls 674, as well as unobstructed view of display 669 and speakers 672. Importantly, the open position 652 also properly positions image sensors 665 and 667 for viewing the golf hitting area, and for capturing images. From this elevated position in the open clamshell, the sensors may capture images of the hitting area to find and locate a golf ball, and when the ball is hit, take images of sufficient frame rate and resolution to measure speed, direction, and spin of the golf ball. To assist in reducing glare and for more flexible positioning, the display 669 may be tiltable. The tilting action me be automatically provided via mechanical connection to the hinge, or may be done manually by the golfer. As described earlier, one or both sensors may also act as a bar coder reader to read a bar code from a golf club, or in some cases, may read other identifying information. Although launch monitor 650 is illustrated without an illumination lamp, it will be understood that a strobe or LED lighting system may be added to assist in illuminating the ball or hitting area.

Figure 16B:
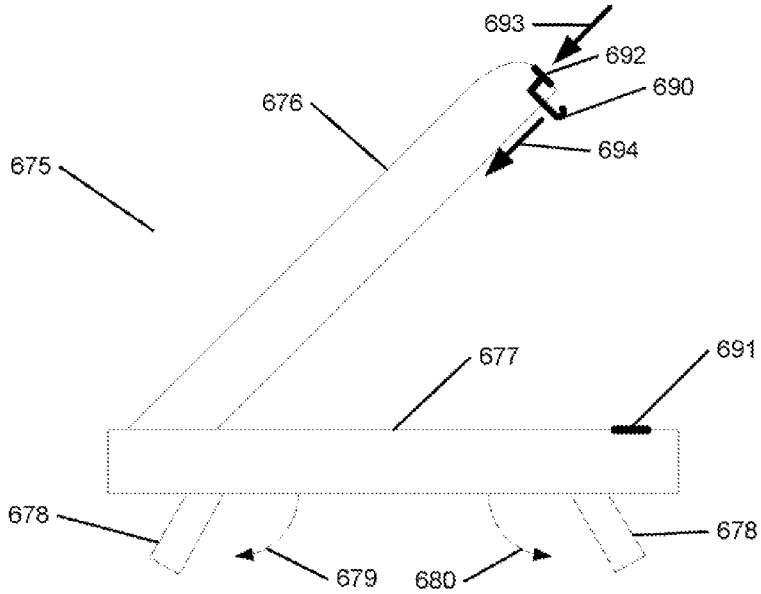
FIGS. 16B-E are illustrations of a launch monitor using a foldable construction with various refinements

Referring now to FIG. 16B, the launch monitor 675 (shown as a foldable monitor with a top housing 676 and a bottom housing 677) may also have foldable legs 678 that extend from the bottom housing 677 as shown by arrows 679 and 680. This would be advantageous, for example, when the monitor 675 is used on grass such that the legs 678 could be extended allowing the launch monitor 675 to sit in a stable position. The legs 678 could also be used to impart stability on other uneven surfaces, or could be used to provide additional elevation, which may be useful when placed adjacent to a raised golf hitting mat or other elevated surface.

Figure 16C:
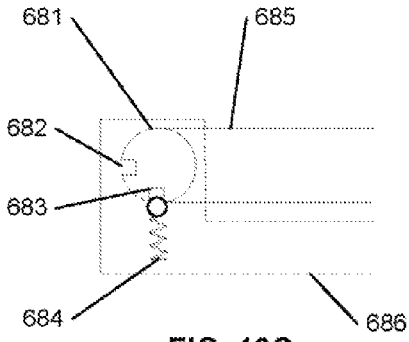
Figure 16D:
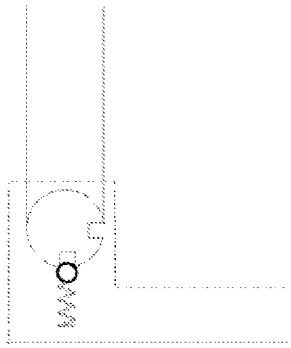
Figure 16E:
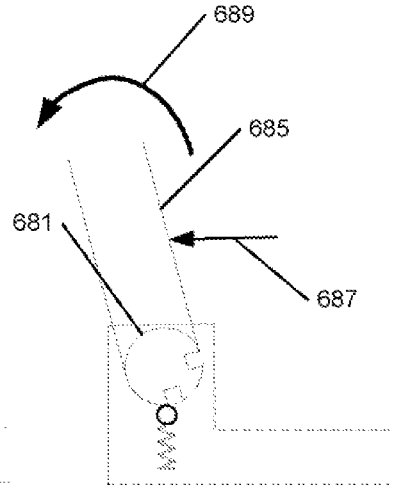

There may also be various configurations of the hinging aspect of the launch monitor. For example, the hinge may be a detent with a single locking position, or may be a detent with several pre-defined locking positions. Referring to FIGS. 16C-E, the hinge 681 may include a two position detent (682 and 683). In FIG. 16C the foldable monitor (with a top housing 685 and bottom housing 686) is in the closed position and the first position of the detent 683 is releaseably locked by a ball tensioned by a spring 684. In FIG. 16D, the foldable monitor is opened and locks in the second position of the detent 682. It would be apparent that the detent may have several locking positions and may be constructed in various ways.

While the locking positions are advantageous in maintaining the sensors in the proper position for optimal image processing, it is possible that an errant golf ball or club may hit the launch monitor. It may therefore be further advantageous to allow the hinge to release from its locked position when the launch monitor experiences an impact with sufficient force. For example, referring now to FIG. 16E, the launch monitor that is struck with a golf ball traveling in the direction of arrow 687 would impart sufficient force to allow the top housing 685 to travel about the hinge 681 in the direction of arrow 689. This allows the hinge 681 to absorb some of the impact and reduces the possible damage to the launch monitor. In yet another embodiment, the hinge may be pre-tensioned such that it opens automatically. Referring back to FIG. 16B, a releasable latch is shown as a hook 690 and a hook receiver 691. This latch binds the top 676 and bottom 676 housings. A user may release the latch by pushing the latch button 692 in the direction of arrow 693, causing the hook to travel in the direction of arrow 694 thereby disengaging from the hook receiver. After the latch is released the user may open the foldable monitor. If the hinge is pre-tensioned, after the latch is released the hinge automatically opens the foldable launch monitor. Adding a dampener would dampen the motion of the pre-tensioned hinge such that the hinge opens in a smooth and controlled motion.

To facilitate ease of setup, the top housing may have an internal tilt gauge that generates sensor angle information. More particularly, the use of a tilt gauge in the top housing relieves the golfer from doing any calibration processes, detailed measurements, setting of special markers, or precision placement of the monitor or ball. Instead, the clamshell monitor may be casually set adjacent to the hitting area, opened, and the sensors directed generally at the hitting area. By automatically adapting to the measured tilt, the clamshell monitor 650 is able to detect and identify a golf ball, and accurately measure and calculate flight path information. This sensor angle information provides information regarding the orientation of the sensors relative to an earth tangential (i.e., to a surface that is level relative to gravity) or other reference plane, and is useful for adjusting processor algorithms. For example, the angle information may be used to more accurately calculate flight information, or may be used in generating directional indicators to assist the golfer in moving the golf ball to a preferred location in the hitting area. It will be understood that the angle information may be used in other ways.

The clamshell monitor is shown in FIG. 16 as having a top and bottom housing whose distal edges 675 (i.e., edge away from the hinge) are relatively even when the monitor is closed. While this configuration can protect the various features of the monitor while it is closed, it will be apparent to one of ordinary skill in the art that the configuration need not have a completely even distal end closure of the top and bottom housing. In fact, the top housing may be narrower than the bottom housing and shorter such that distal ends are not even. For example, the top housing may simply be an arm containing a sensor that is hinged to the bottom housing. The benefit of a narrower profile is that it can reduce the possibility of an errant golf ball strike and the damaged caused thereby.

In a typical use, a golfer will remove the clamshell monitor 650 from his or her cart or bag, and place the clamshell monitor 650 adjacent a hitting mat at a driving range. The golfer opens the clamshell monitor 650, with the sensors generally directed toward the tee location of the mat. The clamshell monitor may automatically power-on when opened, so the golfer need not even power the unit on. Once powered on, the clamshell monitor may automatically perform golf ball detection. Of course, it will be appreciated that a manual power switch may be provided and the golf ball detection may also be manually activated. The golfer places a golf ball on the tee, receives a visual or audible alert that the ball is in a good hitting position, and hits the ball. Flight parameter information is visually or audibly presented. The golfer may proceed to place and hit more balls. When done, the golfer merely closes the clamshell monitor 650 and puts it back into the golf bag.

Figure 17:
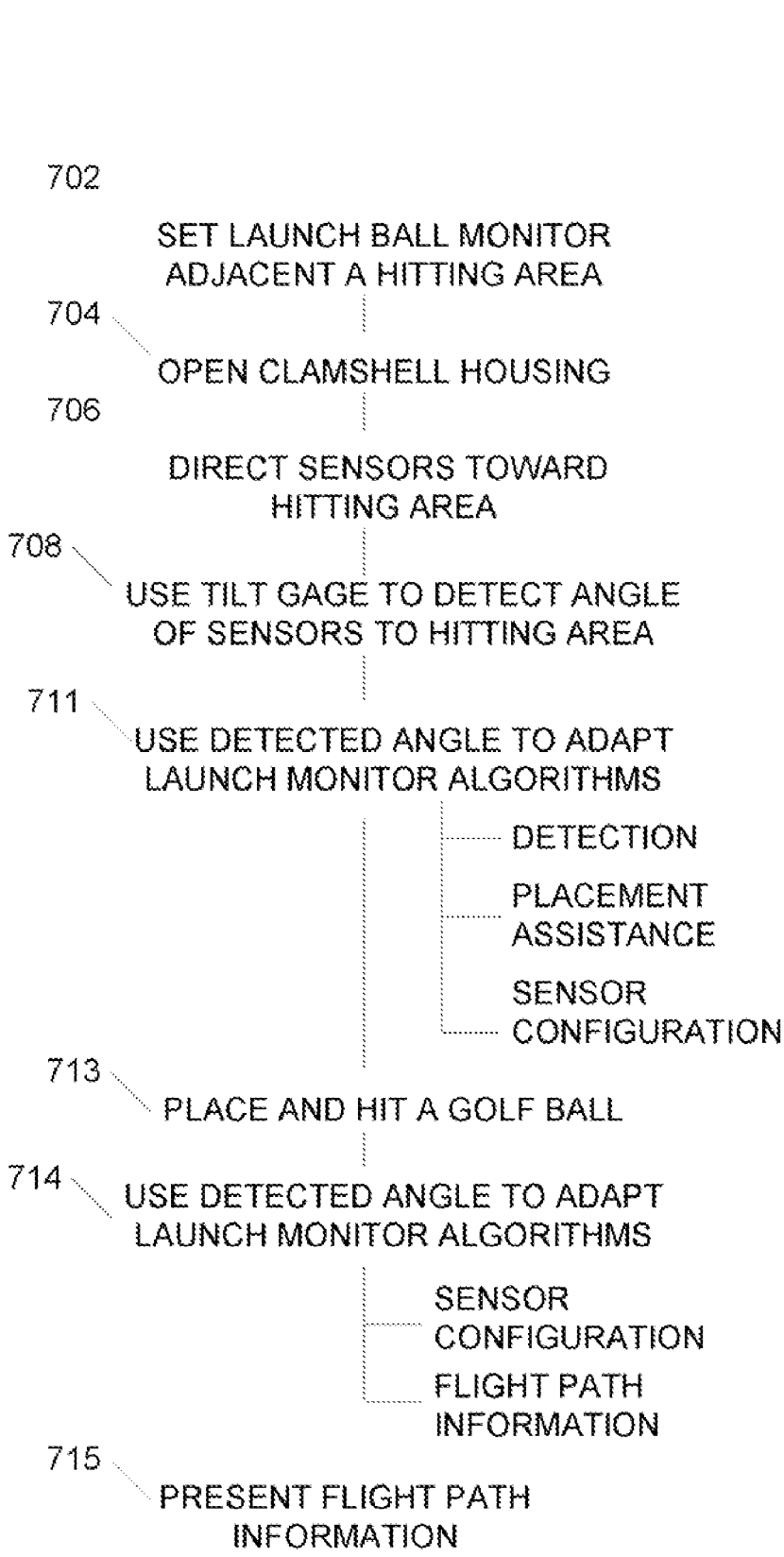
FIG. 17 is a flowchart of using a foldable launch monitor in accordance with the present invention.

Referring now to FIG. 17, a process for using a clamshell launch monitor is illustrated. In process 700, a golfer sets the clamshell monitor adjacent a hitting area, such as mat at a driving range or on a practice putting green as shown in block 702. The golfer opens the clamshell monitor as shown in block 704, and directs the sensors toward the hitting area as shown in block 706. Since the clamshell monitor may automatically power-on when opened, the golfer may not need to power the unit on manually. The clamshell monitor may use an integral tilt gauge to measure and generate sensor angle information as shown in block 708. This angle information is used to automatically adapt launch monitor processes or algorithms as shown in block 711. For example, the angle information may be used to make detection corrections, provide better information for automated placement assistance, or to adjust initial sensor configurations. This could be, for example, window size or exposure. The golfer places and hits the golf ball as shown in block 713. The measured angle information is used to automatically adapt the launch monitor algorithms. Again, this relives the golfer from any complicated setup routine, and enables a more accurate calculation of flight parameter information. It may also be used to adapt or adjust sensors, for example, by setting widow size or frame rate. Flight parameter information is then visually or audibly presented as shown in block 715. It will be appreciated that the launch monitor may also provide directional assistance as previously describe.

While particular preferred and alternative embodiments of the present intention have been disclosed, it will be appreciated that many various modifications and extensions of the above described technology may be implemented using the teaching of this invention. All such modifications and extensions are intended to be included within the true spirit and scope of the appended claims.

What is claimed is:

1. A method for detecting the placement of a golf ball for a launch monitor, the launch monitor measuring flight path parameters of the golf ball, comprising:

capturing an image of a scan zone, the scan zone being an area adjacent the launch monitor and in the field of view of the launch monitor's image sensor;

analyzing the scan zone image for the placement of an object;

capturing, responsive to the placement of the object, a second image; and using the second image in determining if the object is likely the golf ball, wherein the determining step further comprises comparing the object to a predefined physical attribute, the physical attribute selected from a group consisting of size, dimple pattern, reflectivity, roundness, shading, gradient, and position.

2. The method according to claim 1, wherein capturing the image of the scan zone includes using a CMOS sensor or a CCD.

3. The method according to claim 1, wherein the determining step further comprises a frame to frame image comparison.

4. The method according to claim 1, further comprising;

generating an alert that the golf ball has been determined to be in the scan zone.

5. The method according to claim 1, wherein the scan zone further comprises a strike zone, the method further comprising;

generating an alert that the golf ball has been determined to be in the strike zone.

6. The method according to claim 1, further comprising;

generating an alert that the object has been determined not likely to be the golf ball.

7. The method according to claim 1, further comprising capturing a series of scan zone images.

8. The method according to claim 1, wherein analyzing the scan zone image further comprises determining an exposure characteristic or location characteristic for the golf ball.

9. The method according to claim 1, further including the step of illuminating a lamp responsive to analyzing the scan zone image.

10. The method according to claim 1 wherein the second image is of a higher resolution than the image of the scan zone.

11. The method according to claim 1 wherein the first image is of a higher resolution than the image of the scan zone.

12. The method according to claim 1 wherein the image of the scan zone is captured with a first sensor, and the second image is captured with a second sensor.

13. The method according to claim 1 wherein the image of the scan zone is captured with a window on a single sensor, and the second image is captured with a second window on the single sensor.

14. The method according to claim 1 further including using information derived from the scan zone image to adjust exposure or window settings for a next image.

15. The method according to claim 1, further including the step of initiating a trigger sequence responsive to determining the object is a golf ball.

16. A method for detecting the placement of a golf ball for a launch monitor, the launch monitor measuring flight path parameters of the golf ball, comprising:

capturing an image of a scan zone, the scan zone being an area adjacent the launch monitor and in the field of view of the launch monitor's image sensor;

analyzing the scan zone image for the placement of an object;

determining if the object is likely a golf ball;

generating a directional alert responsive to analyzing the scan zone image; and using the directional alert to indicate how the object should be moved to place the object in a strike zone.

17. A method for detecting the placement of a golf ball for a launch monitor, the launch monitor measuring flight path parameters of the golf ball, comprising:

capturing an image of a scan zone, the scan zone being an area adjacent the launch monitor and in the field of view of the launch monitor's image sensor;

analyzing the scan zone image for the placement of an object;

determining if the object is likely a golf ball;

generating a directional alert responsive to analyzing the scan zone images and responsive to determining that the object is likely the golf ball; and using the directional alert to indicate how the golf ball should be moved to place the golf ball in a strike zone.

18. A launch monitor for measuring flight parameters of a golf ball, the monitor comprising:

a processor configured to perform the steps:

capturing an image of a scan zone;

analyzing the scan zone image for the placement of an object;

determining if the object is likely the golf ball, wherein the determining step further comprises comparing the object to a predefined physical attribute, the physical attribute selected from a group consisting of size, dimple patter, reflectivity, roundness, shading, gradient, and position;

locating the golf ball in a strike zone;

capturing a first image of the golf ball;

capturing a second image of the golf ball; and calculating the flight parameters using the first and the second images.

19. The monitor according to claim 18 wherein the processor further performs, the step of using the first image and the second image to track the initial flight path of the golf ball.

20. The monitor according to claim 18 wherein the processor further performs the step of using the first image and the second image to determine if the initial flight path of the golf ball is indicative of a golf ball launch.

21. The monitor according to claim 18 wherein the processor further performs the step of using the first image and the second image to determine if the initial flight path of the golf ball is indicative of a false movement.

22. The monitor according to claim 18 wherein the processor further performs the step of using the first image and the second image to determine if the initial flight path of the golf ball is indicative of a putt.

23. The monitor according to claim 18 wherein the processor further performs the step using the first image and the second image to determine if the initial flight path of the golf ball is indicative of a chip.

24. The monitor according to claim 18 wherein the processor further performs the step of using the first image and the second image to determine if the initial flight path of the golf ball is indicative of a drive.

25. The monitor according to claim 18 wherein the processor further performs the step of capturing the scan zone image, the first image, and the second image using the same sensor device.

26. The monitor according to claim 18, wherein the strike zone image is captured using a first window on a sensor device, the first image is captured using a second window on the sensor device, and the second image is captured using a third window on the sensor device.

27. The monitor according to claim 18 wherein the processor further performs the step of monitoring a trigger zone for launch of the golf ball.

28. The monitor according to claim 27, wherein monitoring for the trigger comprises monitoring an image, monitoring for a sound, or monitoring a radar signal.

29. The monitor according to claim 18 wherein the processor further performs the step of guiding a golfer to move the ball to the strike zone using directional alerts.

30. The monitor according to claim 18 wherein the processor further performs the step of adjusting sensor settings responsive to determining if the golfer is using one of a left hand swing or a right hand swing.

31. The monitor according to claim 18 wherein the processor further performs the step of determining a swing direction, wherein the determining swing direction is automatically determined by an initial position of the golf ball.

32. The monitor according to claim 18 wherein the processor further performs the step of determining a swing direction, wherein the determining swing direction is automatically determined by an initial movement of the golf ball after a strike by a golf club.

33. The monitor according to claim 18 wherein the processor further performs the step of determining a swing direction, wherein the determining swing direction is automatically determined by a movement of a golf club.

34. The monitor according to claim 18 wherein the processor further performs the step of determining a swing direction, wherein the determining swing direction is manually input to the launch monitor.

35. A launch monitor with assisted placement capability, comprising:

a housing;

a sensor arrangement;

an indicator; and a processor configured to operate the steps of:

capturing images of a scan zone using the sensor arrangement;

analyzing the scan zone images for the placement of an object;

determining if the object is likely the golf ball wherein the determining step further comprises comparing the object to a predefined physical attribute, the physical attribute selected from a group consisting of size, dimple pattern, reflectivity, roundness, shading, gradient, and position; and activating the indicator responsive to determining that the object is likely the golf ball.

36. The launch monitor according to claim 35, wherein activating the indicator further comprises:

directing, using the indictor, that the golf ball be moved so as to be placed in a strike zone.

37. The launch monitor according to claim 35, wherein activating the indicator comprises illuminating a direction-indicating lamp set.

38. The launch monitor according to claim 35, wherein activating the indicator comprises illuminating a lamp.

39. The launch monitor according to claim 35, wherein activating the indicator comprises generating an audible alert.

40. The launch monitor according to claim 35, wherein the indicator comprises an LCD display, an LED lamp, or an incandescent lamp.

41. The method according to claim 40, further including the steps of:

determining an exposure characteristic or a location characteristic of the placed golf ball; and using the determined characteristic to assist image capture of the golf ball in flight.

* * * * *